US010481545B2

(12) United States Patent
Isaka

(10) Patent No.: US 10,481,545 B2
(45) Date of Patent: Nov. 19, 2019

(54) IMAGE FORMING APPARATUS WITH MULTIPLE IMAGE BEARERS

(71) Applicant: Takayuki Isaka, Kanagawa (JP)

(72) Inventor: Takayuki Isaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/908,916

(22) Filed: Mar. 1, 2018

(65) Prior Publication Data

US 2018/0267455 A1 Sep. 20, 2018

(30) Foreign Application Priority Data

Mar. 16, 2017 (JP) ..... 2017-051413

(51) Int. Cl.
*G03G 21/18* (2006.01)
*G03G 21/16* (2006.01)
*G03G 15/00* (2006.01)

(52) U.S. Cl.
CPC ..... *G03G 15/757* (2013.01); *G03G 21/1647* (2013.01); *G03G 21/1857* (2013.01)

(58) Field of Classification Search
CPC ..... G03G 21/1857
See application file for complete search history.

(56) References Cited

U.S. PATENT DOCUMENTS 6,771,919 B2 * 8/2004 Koide ..... G03G 15/757 347/116
2014/0119777 A1 * 5/2014 Fujimoto ..... G03G 21/1647 399/167
2015/0053032 A1 * 2/2015 Yamazaki ..... F16D 11/00 74/412 R

FOREIGN PATENT DOCUMENTS

JP 2014-089371 5/2014

* cited by examiner

*Primary Examiner* — Victor Verbitsky
(74) *Attorney, Agent, or Firm* — Harness Dickey & Pierce, P.L.C.

(57) ABSTRACT

An image forming apparatus includes multiple image bearers, multiple image bearer gears, a drive source, an output gear, a drive transmission body, multiple relay gears, and multiple drive gears. A center of rotation of each of the multiple drive gears to which a driving force is transmitted from the drive source is located downstream from a corresponding one of the multiple relay gears in a rotation direction of the corresponding one of the multiple relay gears, relative to a virtual line segment connecting a center of rotation of the corresponding one of the multiple relay gears connected to the multiple drive gears and the center of rotation of a corresponding one of the multiple image bearer gears.

6 Claims, 17 Drawing Sheets

IMAGE FORMING APPARATUS WITH MULTIPLE IMAGE BEARERS

CROSS-REFERENCE TO RELATED APPLICATION

This patent application is based on and claims priority pursuant to 35 U.S.C. § 119(a) to Japanese Patent Application No. 2017-051413, filed on Mar. 16, 2017, in the Japan Patent Office, the entire disclosure of which is hereby incorporated by reference herein.

BACKGROUND

Technical Field

This disclosure an image forming apparatus that corresponds to a copier, printer, facsimile machine, and a multifunctional apparatus including at least two functions of the copier, printer, and facsimile machine.

Related Art

Known image forming apparatuses generally include multiple image bears such as photoconductors and a drive output gear. The drive output gear outputs a rotation driving force a rotation driving force applied by a drive source and transmits the rotation driving force to the multiple image bearers via multiple gears.

A known image forming apparatus discloses a configuration in which such a rotation driving force applied by the drive output gear is transmitted to a relay gear, so that the rotation driving force is transmitted to an image bearer gear mounted coaxially with the multiple image bearers via the relay gear and a drive gear. In this image forming apparatus, a rotation driving force of one drive output gear is transmitted to three relay gears directly or via other gears. Accordingly, one drive source drives and rotates three image bearers.

SUMMARY

At least one aspect of this disclosure provides an image forming apparatus including multiple image bearers having respective shafts, multiple image bearer gears mounted on the respective shafts of the multiple image bearers, a drive source, an output gear, a drive transmission body, multiple relay gears, and multiple drive gears. The drive source is configured to rotate the multiple image bearers. The output gear is configured to output a driving force applied by the drive source. The multiple relay gears have respective shafts and are configured to receive and relay the driving force from the output gear directly or via the drive transmission body to the multiple image bearer gears. The multiple drive gears have respective shafts and are configured to connect to the multiple relay gears and the multiple image bearer gears and to transmit the driving force from the multiple relay gears to the multiple image bearer gears. A center of rotation of each of the multiple drive gears to which the driving force is transmitted from the drive source is located downstream from a corresponding one of the multiple relay gears in a rotation direction of the corresponding one of the multiple relay gears, relative to a virtual line segment connecting a center of rotation of the corresponding one of the multiple relay gears connected to the multiple drive gears and the center of rotation of a corresponding one of the multiple image bearer gears.

Further, at least one aspect of this disclosure provides an image forming apparatus including multiple image bearers having respective shafts, multiple image bearer gears mounted on the respective shafts of the multiple image bearers, a drive source, an output gear, a drive transmission body, multiple relay gears, and multiple drive gears. The drive source is configured to rotate the multiple image bearers. The output gear is configured to output a driving force applied by the drive source. The multiple relay gears include a first relay gear and a second relay gear to which the driving force is input from the first relay gear. The multiple drive gears have respective shafts and are configured to connect to the multiple relay gears and the multiple image bearer gears and to transmit the driving force from the multiple relay gears to the multiple image bearer gears. The multiple drive gears include a first drive gear configured to connect to the first relay gear. A center of rotation of each of the first drive gear is located downstream from the first relay gear in a rotation direction of the first relay gear, relative to a virtual line segment connecting a center of rotation of the first relay gear and the center of rotation of the first drive gear.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
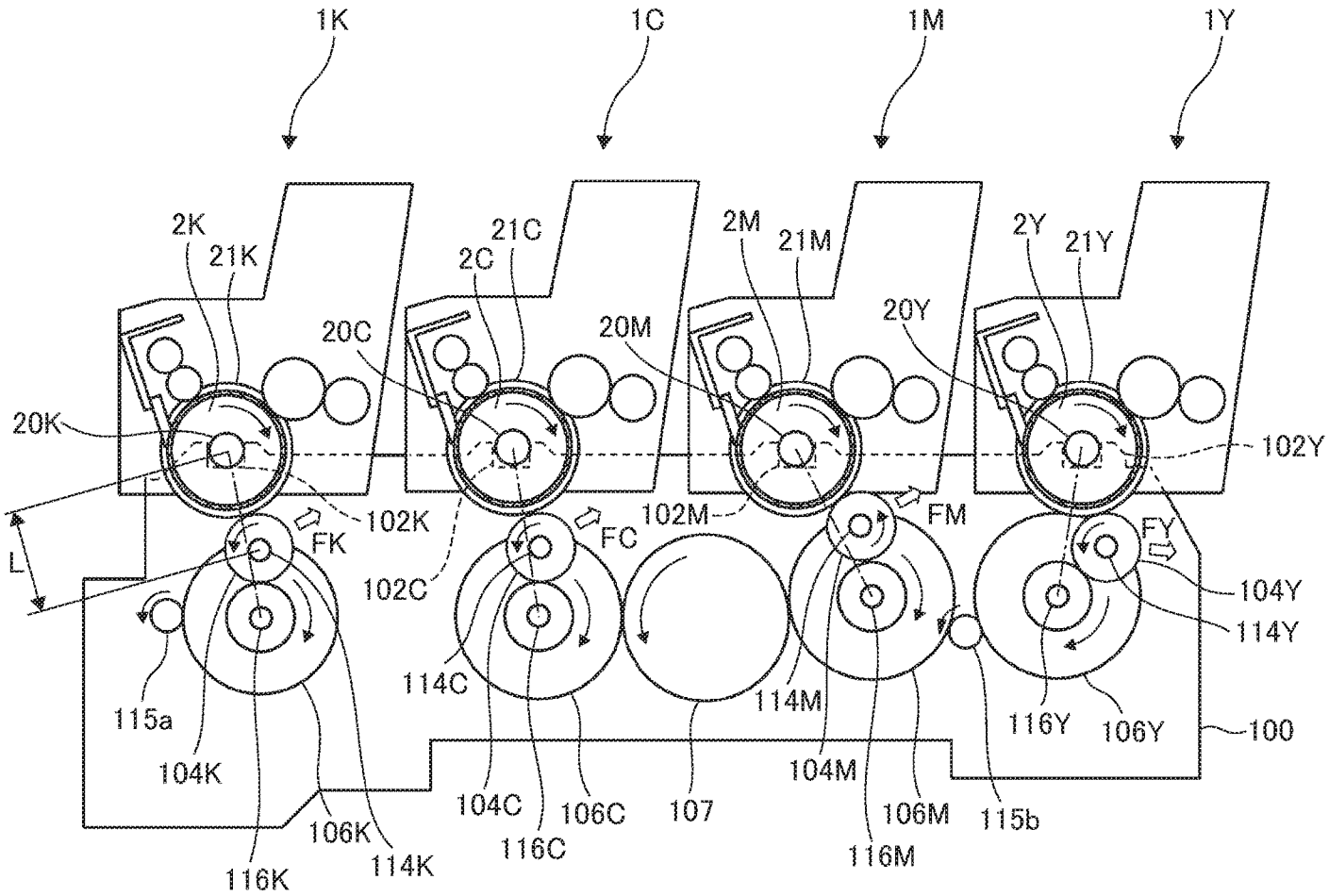
FIG. 1 is a diagram illustrating four photoconductors and respective gears transmitting respective driving forces to the four photoconductors, included in an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic color image forming apparatus 10 for forming images by electrophotography, according to an embodiment of this disclosure. It is to be noted that, hereinafter, the electrophotographic color image forming apparatus 10 is referred to as the image forming apparatus 10.

Figure 2:
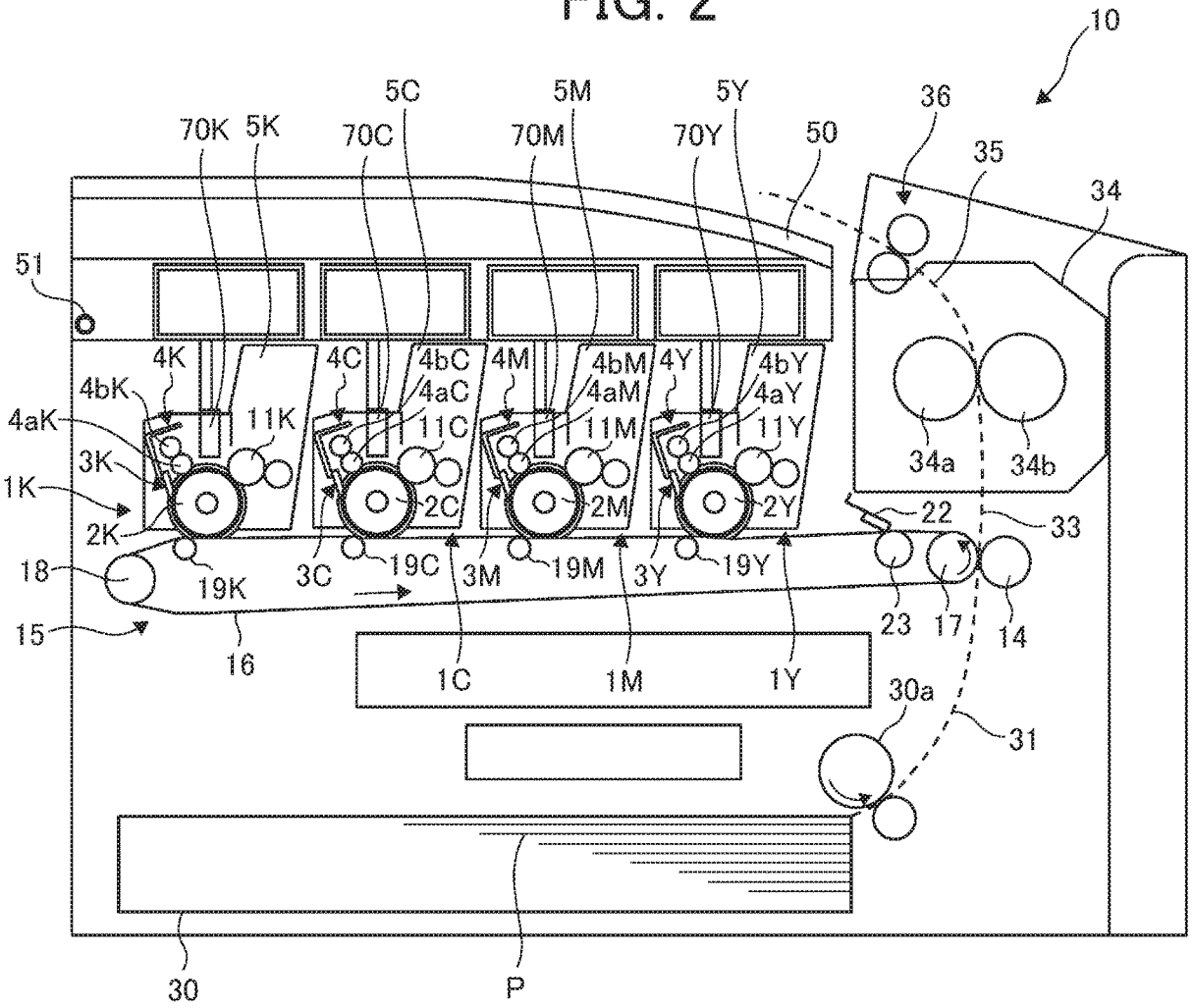
FIG. 2 is a diagram illustrating a schematic configuration of the image forming apparatus.

A description is given of a basic configuration of the image forming apparatus 10 according to the present embodiment of this disclosure, with reference to FIG. 2.

FIG. 2 is a schematic diagram illustrating an entire configuration of the image forming apparatus 10 according to the present embodiment of this disclosure.

The image forming apparatus 10 may be a copier, a facsimile machine, a printer, a multifunction peripheral or a multifunction printer (MFP) having at least one of copying, printing, scanning, facsimile, and plotter functions, or the like. According to the present example, the image forming apparatus 10 is an electrophotographic printer that prints toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 2, the image forming apparatus 10 (that is a printer engine in this disclosure) includes four image forming units 1Y, 1M, 1C, and 1K to form yellow (Y), magenta (M), cyan (C), and black (K) toner images, respectively. The configurations of the image forming units 1Y, 1M, 1C and 1K are basically identical to each other, except that the image forming units 1Y, 1M, 1C and 1K include toners of different colors as image forming substances. Each of the image forming units 1Y, 1M, 1C and 1K is replaced at the end of its service life.

Further, the image forming apparatus 10 includes four writing units 70Y, 70M, 70C and 70K, each of which functions as a latent image forming device.

An intermediate transfer belt 16 that functions as an intermediate transfer body is disposed below the image forming units 1Y, 1M, 1C and 1K in FIG. 2. Respective toner images formed on the image forming units 1Y, 1M, 1C and 1K are transferred onto a surface of the intermediate transfer belt 16.

A secondary transfer roller 14 is disposed on the right side of the intermediate transfer belt 16 in FIG. 2. The secondary transfer roller 14 transfers a composite toner image transferred and formed on the surface of the intermediate transfer belt 16 onto a sheet P.

A fixing device 34 is disposed above the secondary transfer roller 14, so as to fix the toner image formed on the sheet P to the sheet P.

A pair of sheet output rollers 36 is disposed above the fixing device 34. The pair of sheet output rollers 36 conveys and discharges the sheet P with the fixed toner image thereon, to the outside of an apparatus body of the image forming apparatus 10.

As illustrated in FIG. 2, the image forming apparatus 10 includes the image forming units 1Y, 1M, 1C, and 1K to form yellow (Y), magenta (M), cyan (C), and black (K) toner images, respectively. Hereinafter, the units and components included in the image forming apparatus 10 are often referred to in a singular form without suffix indicating toner colors. For example, the image forming units 1Y, 1M, 1C, and 1K may be referred to as "the image forming unit 1".

As illustrated in FIG. 2, the image forming unit 1 (i.e., the image forming units 1Y, 1M, 1C, and 1K) includes a drum-shaped photoconductor 2 (i.e., photoconductors 2Y, 2M, 2C and 2K), a drum cleaning unit 3 (i.e., drum cleaning units 3Y, 3M, 3C and 3K), a static eliminator, a charging unit 4 (i.e., charging units 4Y, 4M, 4C and 4K), and a developing device 5 (i.e., developing devices 5Y, 5M, 5C and 5K). The image forming unit 1 is a process cartridge that is detachably attachable to the apparatus body of the image forming apparatus 10. Accordingly, parts and units in the image forming unit 1 reaching each service life can be replaced at a time.

The photoconductor 2 is rotated by a drive unit (i.e., a first drive motor 105*a* that is described later) in a clockwise direction in FIG. 2.

The charging unit 4 includes a charging roller 4*a* (i.e., charging rollers 4*a*Y, 4*a*M, 4*a*C and 4*a*K) and a collection roller 4*b* (i.e., collection rollers 4*b*Y, 4*b*M, 4*b*C and 4*b*K). The charging roller 4*a* rotates in the counterclockwise direction in FIG. 2 while being in contact with the photoconductor 2. The collection roller 4*b* collects toner adhered to the charging roller 4*a*.

The developing device 5 includes a developing roller 11 (i.e., developing rollers 11Y, 11M, 11C and 11K) which rotates while being in contact with the photoconductor 2.

The writing unit 70 includes multiple light emitting elements such as a light emitting diode (LED) array and/or organic electroluminescence (EL) elements arranged in the axial direction of the photoconductor 2. The writing unit 70 turns on any of the multiple light emitting elements, which is located at a specified position based on image data, and exposes the charged surface of the photoconductor 2. Therefore, an electrostatic latent image for a given single color toner image is formed on the surface of the photoconductor 2.

When performing image formation, an electric discharge is generated between the charging roller 4*a* and the photoconductor 2, so that the surface of the photoconductor 2 is uniformly charged.

When the writing unit 70 exposes the uniformly charged surface of the photoconductor 2, an electrostatic latent image is formed thereon. The electrostatic latent image is developed with toner by the developing device 5 into a toner image. The developing device 5 supplies toner held by a surface of the developing roller 11 to the electrostatic latent image formed on the surface of the photoconductor 2, at a developing area at which the developing roller 11 and the photoconductor 2 contact to each other. By so doing, the developing device 5 develops the electrostatic latent image to a single color toner image with a corresponding color toner. The single color toner image is later transferred onto a surface of an intermediate transfer belt 16.

The drum cleaning unit 3 removes residual toner remaining on the surface of the photoconductor 2 after the single color toner image has been transferred onto the surface of the intermediate transfer belt 16, so that the surface of the photoconductor 2 is cleaned.

The charge removing unit electrically removes residual charge remaining on the surface of the photoconductor 2 after the drum cleaning unit 3 cleaned the surface of the photoconductor 2. This removal of static electricity initializes the surface of the photoconductor 2, so as to prepare for a subsequent image forming operation.

As previously described, the above-described detailed operations are performed in each of the process units 1Y, 1M, 1C and 1K. For example, respective toner images are developed on the respective surfaces of the photoconductors 2Y, 2M, 2C and 2K and are then sequentially transferred onto the surface of the intermediate transfer belt 16 to form a composite color image.

The image forming apparatus 10 further includes a transfer unit 15 disposed below the image forming units 1Y, 1M, 1C, and 1K. The transfer unit 15 functions as a transfer device to rotate the intermediate transfer belt 16 having an endless loop in a counterclockwise direction of FIG. 2 while stretching the intermediate transfer belt 16. The transfer unit 15 includes the intermediate transfer belt 16, and further includes a drive roller 17, a driven roller 18, four primary transfer rollers 19Y, 19M, 19C and 19K (hereinafter, often referred to as a primary transfer roller 19), a secondary transfer roller 14, a belt cleaning unit 22, and a cleaning backup roller 23.

The intermediate transfer belt 16 is stretched with a tension around the drive roller 17, the driven roller 18, the primary transfer rollers 19Y, 19M, 19C, and 19K, and the cleaning backup roller 23 to be rotated thereby. The drive roller 17, the driven roller 18, the primary transfer rollers 19Y, 19M, 19C, and 19K, and the cleaning backup roller 23 are disposed inside the loop of the endless intermediate transfer belt 16. A belt drive motor that functions as a drive unit rotates the drive roller 17 in the counterclockwise direction in FIG. 2. With a rotational force or torque of the drive roller 17 in the counterclockwise direction in FIG. 2, the intermediate transfer belt 16 is rotated in the same direction as the drive roller 17.

The four primary transfer rollers 19Y, 19M, 19C and 19K hold the intermediate transfer belt 16 that rotates endlessly with the photoconductors 2Y, 2M, 2C and 2K. By so doing, four primary transfer nip regions are formed on respective four positions where a front face of the intermediate transfer belt 16 contacts the respective photoconductors 2Y, 2M, 2C and 2K.

Primary transfer biases are applied by a transfer power supply to the primary transfer rollers 19Y, 19M, 19C, and 19K, respectively. Accordingly, a transfer electric field is formed in each transfer nip region formed between the electrostatic latent image of the photoconductor 2 (i.e., the photoconductors 2Y, 2M, 2C and 2K) and the primary transfer roller 19 (i.e., the primary transfer rollers 19Y, 19M, 19C and 19K). It is to be noted that the primary transfer roller 19 may be replaced with a transfer charger or a transfer brush.

Thereafter, when the yellow, magenta, cyan, and black toner images formed on the photoconductors 2Y, 2M, 2C and 2K enters the primary transfer nip region along with rotation of the photoconductors 2Y, 2M, 2C and 2K, respectively, the respective toner images are primarily transferred from the photoconductors 2Y, 2M, 2C and 2K to the intermediate transfer belt 16, due to the transfer electric field and the nip pressure. With this image forming operation, the respective toner images are primarily transferred in layers subsequently onto the intermediate transfer belt 16. By primarily transferring the single color toner images, a four-color toner image is formed on the intermediate transfer belt 16.

The secondary transfer roller 14 included in the transfer unit 15 is disposed outside the loop of the intermediate transfer belt 16 to hold the intermediate transfer belt 16 with the drive roller 17 disposed inside the loop of the intermediate transfer belt 16. By so doing, a secondary transfer nip region is formed between a front face of the intermediate transfer belt 16 and the secondary transfer roller 14. A secondary transfer bias is applied by the transfer bias power supply to the secondary transfer roller 14. This application of the secondary transfer bias forms a secondary transfer electric field between the secondary transfer roller 14 and the drive roller 17 that is electrically grounded.

A sheet tray 30 is disposed vertically below the transfer unit 15. The sheet tray 30 contains multiple sheets P in a bundle of sheets. The sheet tray 30 is detachably attached to the apparatus body of the image forming apparatus 10. The sheet tray 30 includes a feed roller 30*a* that is disposed in contact with an uppermost sheet P that is placed on top of the bundle of sheets. As the feed roller 30*a* rotates in the counterclockwise direction in FIG. 2 at a predetermined timing, the sheet P is fed toward a sheet conveyance passage 31 in the image forming apparatus 10.

A pair of registration rollers is disposed in a vicinity of a terminal end of the sheet conveyance passage 31. The sheet P fed from the sheet tray 30 reaches the pair of registration rollers disposed before the secondary transfer nip region in the sheet conveying direction. The pair of registration rollers stops rotating on receipt of the sheet P to hold between the rollers thereof. After the pair of registration rollers has started the rotation again at a timing to synchronize with the four-color toner image formed on the intermediate transfer belt 16 within the secondary transfer nip region, the sheet P is conveyed toward the secondary transfer nip region.

The four-color toner image formed on the intermediate transfer belt 16 contacts the sheet P in the secondary transfer nip area. Due to action of the secondary electric field and a nip pressure in the secondary transfer nip area, the four-color toner image is secondarily transferred onto the sheet P. By being mixed with a white color of a surface of the sheet P, the four-color toner image is developed to a full color toner image. Then, after having passed the secondary transfer nip region, the sheet P having the full color toner image formed on the surface thereof passes through a post transfer sheet conveyance passage 33 to the fixing device 34.

After the toner image from the intermediate transfer belt 16 onto the sheet P has passed the secondary transfer nip area, residual toner remains on the surface of the intermediate transfer belt 16. The residual toner is removed from the surface of the intermediate transfer belt 16 by the belt cleaning unit 22 that is disposed in contact with the outer surface of the intermediate transfer belt 16. The cleaning backup roller 23 that is disposed inside the loop of the intermediate transfer belt 16 supports (backup) a belt cleaning operation performed by the belt cleaning unit 22 from inside the loop of the intermediate transfer belt 16.

The fixing device 34 includes a fixing roller 34*a* and a pressure roller 34*b*. The fixing roller 34*a* includes a heat source such as a halogen lamp therein. The pressure roller 34*b* is disposed in contact with the fixing roller 34*a* with a predetermined pressure and rotates with the fixing roller 34*a* by friction. The full color toner image formed on the sheet P that is conveyed into the fixing device 34 is fixed to the sheet P by application of heat and pressure.

After passing through the fixing device 34, the sheet P is output by the pair of sheet output rollers 36 via the post-fixing sheet conveying passage 35 and stacked in a sheet stacking portion that is provided on an upper face of a top cover 50 of the apparatus body of the image forming apparatus 10.

Figure 3:
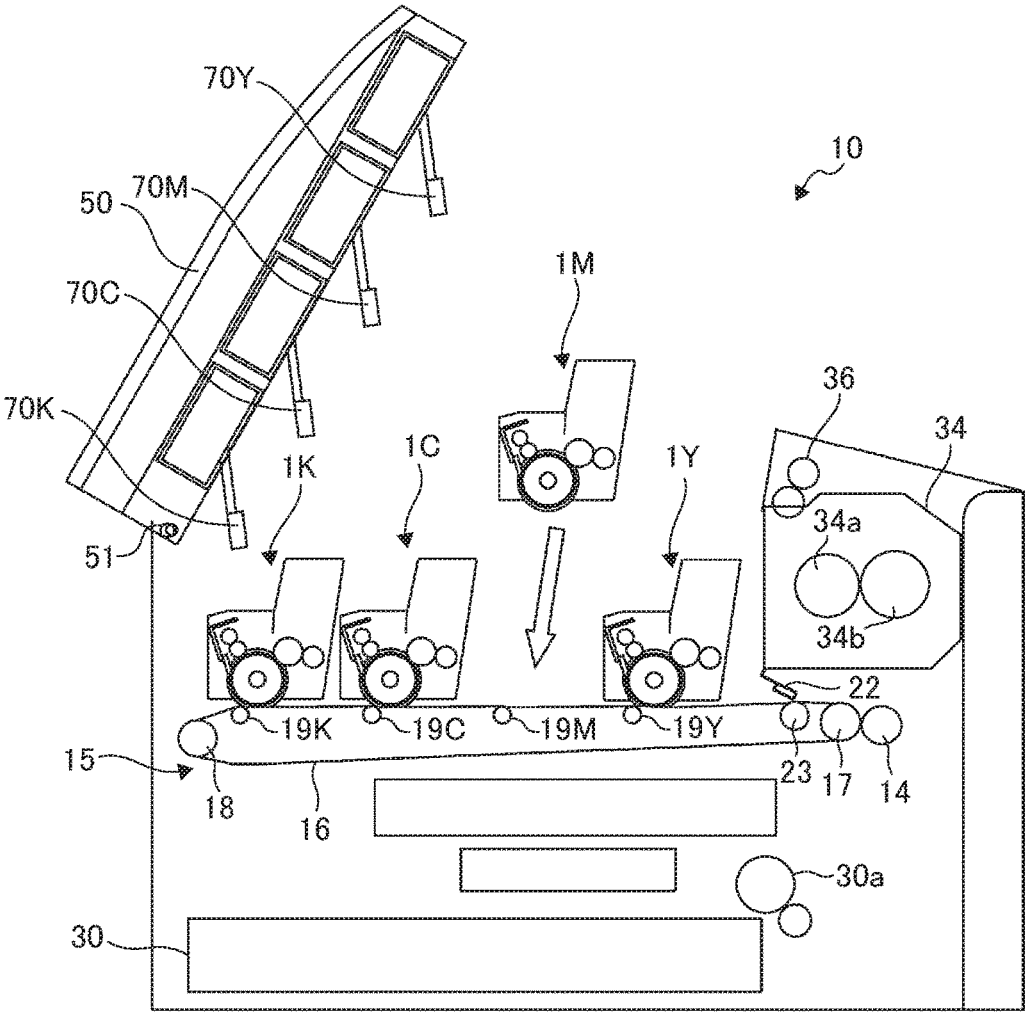
FIG. 3 is a diagram illustrating the image forming apparatus in a state that a top cover thereof is open.

FIG. 3 is a diagram illustrating the image forming apparatus 10 in a state that the top cover 50 is open, relative to the apparatus body of the image forming apparatus 10.

The top cover 50 of the apparatus body of the image forming apparatus 10 is rotatably supported by a shaft 51 of the top cover 50 with respect to the apparatus body of the image forming apparatus 10. By rotating in the counterclockwise direction in FIG. 2, the top cover 50 opens from the apparatus body of the image forming apparatus 10 as illustrated in FIG. 3. With this action, an upper portion of the apparatus body of the image forming apparatus 10 is widely opened and the image forming units 1Y, 1M, 1C, and 1K provided in the apparatus body of the image forming apparatus 10 are exposed. With the top cover 50 being open to the apparatus body of the image forming apparatus 10, the image forming units 1Y, 1M, 1C, and 1K can be attached thereto and removed therefrom. With this configuration, the performance in replacement of each image forming unit 1 and in maintenance of the photoconductor 2 and the developing device 5 included in the image forming unit 1 can be enhanced.

The writing units 70Y, 70M, 70C and 70K are supported by the top cover 50. By remaining the top cover 50 open with respect to the apparatus body of the image forming apparatus 10, the writing units 70Y, 70M, 70C and 70K are detached from the apparatus body to the outside thereof.

Now, a description is given of a comparative electrophotographic image forming apparatus.

The comparative electrophotographic image forming apparatus has a configuration provided with multiple process cartridges, each of which including a photoconductor and a developing roller and being detachably attachable to an apparatus body of the comparative image forming apparatus. That is, when the process cartridges are attached to the apparatus body of the comparative image forming apparatus, a shaft coaxially mounted with the photoconductor and a drive unit on the side of the apparatus body are coupled with a coupling, so as to drive the photoconductor.

Further, another comparative image forming apparatus is known to have a configuration in which a driving force is transmitted by coupling a photoconductor gear mounted on the photoconductor and a photoconductor drive gear mounted on the apparatus body of the comparative image forming apparatus.

Of these configurations, the configuration in which the shaft of the photoconductor and the drive unit on the side of the apparatus body are coupled by a coupling includes a large number of parts and components, and therefore the manufacturing cost increases and the configuration becomes complicated. By contrast, in the configuration in which a driving force is transmitted by coupling a photoconductor gear mounted on the photoconductor and a photoconductor drive gear mounted on the apparatus body of the comparative image forming apparatus, a center distance between the shaft of the photoconductor gear and the shaft of the photoconductor drive gear is determined with multiple parts interposed between the shafts. Therefore, due to accumulated errors of processing accuracy of parts of the image forming apparatus and/or in assembly of the parts, an accurate center distance between the shaft of the photoconductor gear and the shaft of the photoconductor drive gear cannot be obtained easily. Consequently, due to the center distance of the shafts being different from a target distance, vibration occurs when the gears are driven, which is likely to cause image failure such as banding on an image transferred onto a sheet such as a transfer paper due to the vibration.

By contrast, a drive unit having the photoconductor drive gear can be assembled to the apparatus body of an image forming apparatus with high accuracy by using a positioning jig. By so doing, the accuracy between the shaft of the photoconductor gear and the shaft of the photoconductor drive gear can be obtained. However, such a positioning jig or a positioning tool is needed when replacing the drive unit in maintenance, which takes time in replacement of the drive unit.

Next, a description is given of how to drive the photoconductor 2 in the image forming apparatus 10 according to the present embodiment of this disclosure.

Figure 4:
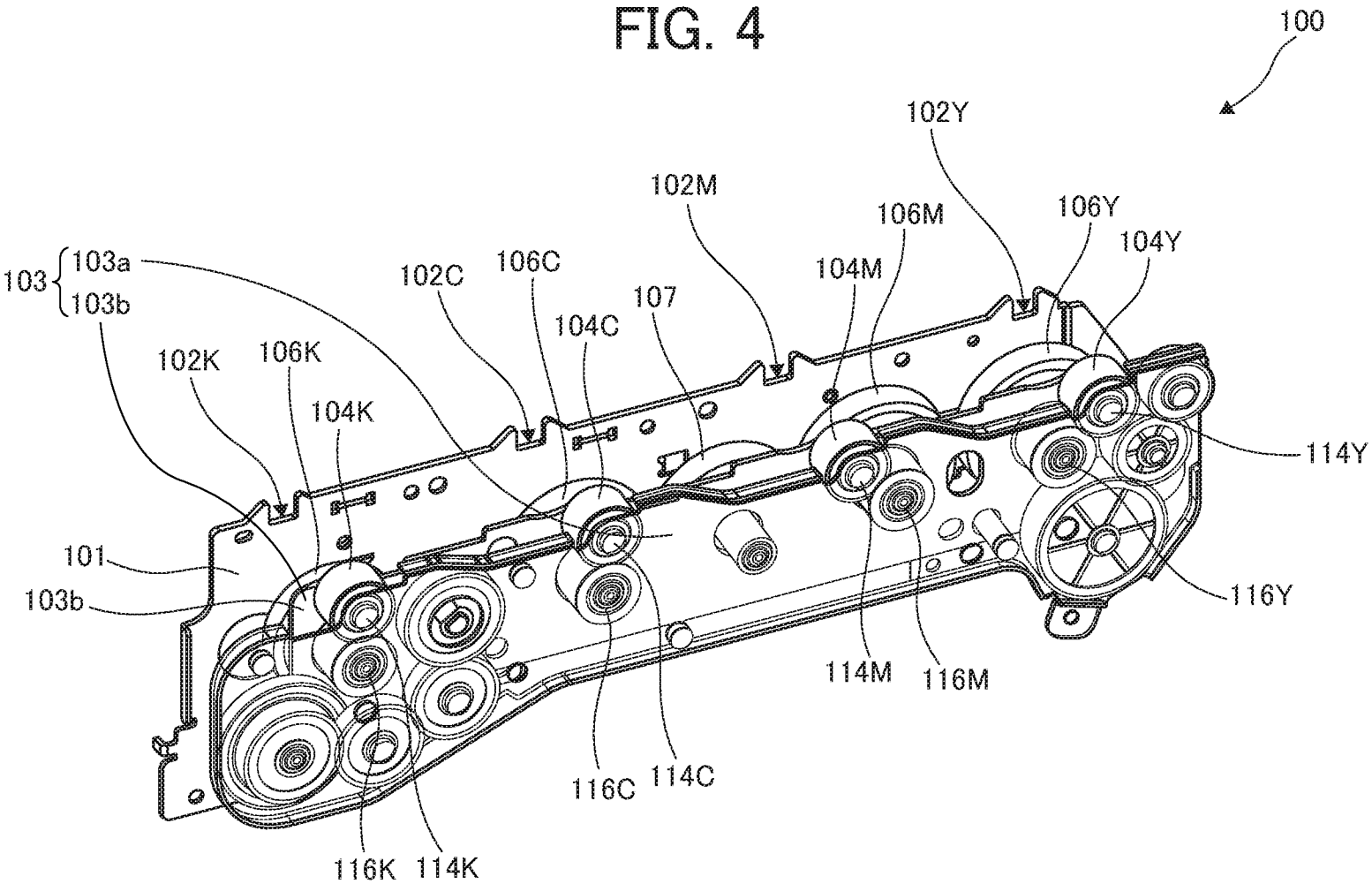
FIG. 4 is a perspective view illustrating the photoconductor drive unit.
Figure 5:
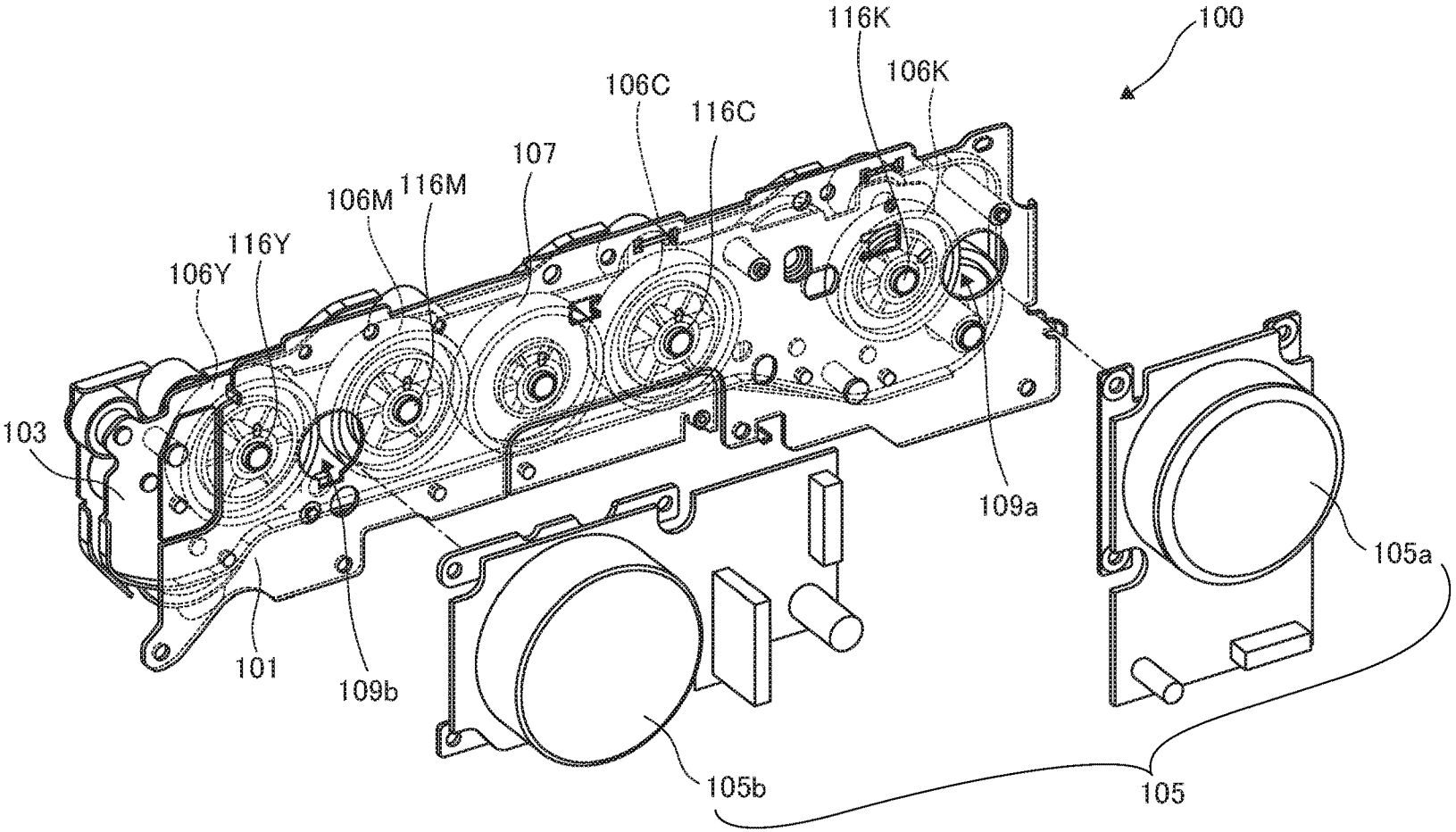
FIG. 5 is a diagram illustrating positional relations of two drive motors and photoconductor drive units.

FIG. 1 is a diagram illustrating four photoconductors 2Y, 2M, 2C and 2K and respective gears transmitting respective driving forces to the four photoconductors 2Y, 2M, 2C and 2K, included in the tandem-type image forming apparatus 10 according to an embodiment of this disclosure. FIG. 4 is a perspective view illustrating a photoconductor drive unit 100 including the gears to transmit the driving force to the photoconductors 2Y, 2M, 2C and 2. FIG. 5 is a diagram illustrating positional relations of a first drive motor 105*a* and a second drive motor 105*b*, both of which function as drive sources of the photoconductor 2 and the photoconductor drive unit 100.

A first output gear is fixedly mounted on a drive shaft of the first drive motor 105*a*. A second output gear 115*b* is fixedly mounted on a drive shaft of the second drive motor 105*b*.

The first drive motor 105*a* is a drive source of the image forming unit 1K and the second drive motor 105*b* is a drive source of the other three image forming units 1Y, 1M and 1C.

In a state in which the image forming units 1Y, 1M, 1C, and 1K are attached to the body of the image forming apparatus 10, photoconductor center shafts 20Y, 20M, 20C and 20K are positioned to photoconductor positioning portions 102Y, 102M, 102C and 102K, respectively, in the photoconductor drive unit 100. The photoconductor center shafts 20Y, 20M, 20C and 20K function as rotary shafts of the photoconductors 2Y, 2M, 2C and 2K, respectively, and the photoconductor positioning portions 102Y, 102M, 102C and 102K function as holding portions. Accordingly, the image forming units 1Y, 1M, 1C and 1K are positioned in the apparatus body of the image forming apparatus 10.

The photoconductors 2Y, 2M, 2C and 2K included in the image forming apparatus 10 are driven by more than one drive source. In the present embodiment, two drive motors, which are the first drive motor 105*a* and the second drive motor 105*b*, are provided to the image forming apparatus 10 as drive sources to drive the four photoconductors 2Y, 2M, 2C and 2K.

A driving force output by the first output gear 115*a* is transmitted to a drive gear 104K via a relay gear 106K to drive a photoconductor gear 21K that is mounted on the same shaft as the photoconductor 2K. Accordingly, the photoconductor 2K is driven and rotated.

A driving force output by the second output gear 115*b* is transmitted to a drive gear 104Y and a drive gear 104M via a relay gear 106Y and a relay gear 106M, respectively. The driving force transmitted to the drive gear 104Y drives a photoconductor gear 21Y that is mounted on the same shaft as the photoconductor 2Y. Similarly, the driving force transmitted to the drive gear 104M drives a photoconductor gear 21M that is mounted on the same shaft as the photoconductor 2M. Accordingly, the photoconductors 2Y and 2M are driven and rotated.

Regarding transmission of the driving force to the photoconductor 2C, the driving force output by the second output gear 115*b* is first transmitted to a drive distributing relay gear 107 via a relay gear 106M. The driving force transmitted to the drive distributing relay gear 107 is transmitted to a drive gear 104C via a relay gear 106C, so as to drive a photoconductor gear 21C that is mounted on the same shaft as the photoconductor 2C. Accordingly, the photoconductor 2C is driven and rotated.

The four drive gears 104Y, 104M, 104C and 104K are idler gears. Further each of the four relay gears 106Y, 106M, 106C and 106K is a two-step gear including a small diameter gear 106*a* that is meshed with the drive gear 104 (i.e., the drive gears 104Y, 104M, 104C and 104K) and a large diameter gear 106*b* that is meshed with the output gear 115 or the drive distributing relay gear 107.

As illustrated in FIG. 4, the photoconductor drive unit 100 that functions as a unit side plate includes a photoconductor positioning member 101 and a drive gear holder 103. The photoconductor positioning member 101 functions as a first holder. In the present embodiment, the drive gear holder 103 includes a first drive gear holding member 103*a* and a second drive gear holding member 103*b*. The photoconductor positioning member 101 includes the photoconductor positioning portions 102Y, 102M, 102C and 102K to hold and position the photoconductor center shafts 20Y, 20M, 20C and 20K of the photoconductor gears 21Y, 21M, 21C and 21K, respectively. The first drive gear holding member 103*a* holds rotary shafts 114Y, 114M, 114C and 114K of the drive gears 104Y, 104M, 104C and 104K, respectively.

The second drive gear holding member 103*b* that functions as a fixing body is disposed at a position between the photoconductor positioning member 101 and the first drive gear holding member 103*a*. The photoconductor positioning member 101 and the first drive gear holding member 103*a* are fixedly attached to the second drive gear holding member 103*b*. In the photoconductor drive unit 100, each of the three members, which are the photoconductor positioning member 101, the first drive gear holding member 103*a* and the second drive gear holding member 103*b*, is fixed by any other one member thereof. That is, the photoconductor positioning member 101 and the first drive gear holding member 103*a* are fixed to each other, the first drive gear holding member 103*a* and the second drive gear holding member 103*b* are fixed to each other, and the second drive gear holding member 103*b* and the photoconductor positioning member 101 are fixed to each other. Accordingly, the photoconductor drive unit 100 includes a layered structure formed with the photoconductor positioning member 101, the first drive gear holding member 103*a* and the second drive gear holding member 103*b*. With this layered structure, strength of the photoconductor drive unit 100 increases. Accordingly, vibration of the photoconductor drive unit 100 caused by rotations of the gears decreases.

The photoconductor drive unit 100 transmits a driving force from the drive motor 105 to the photoconductor 2 via gears such as the drive gear 104 and the photoconductor gear 21 by meshing the drive gear 104 and the photoconductor gear 21. Different from the above-described comparative image forming apparatus that employs the coupling mechanism, the photoconductor drive unit 100 according to the present embodiment of this disclosure can prevent an increase in costs and a complicated structure.

In the image forming apparatus 10 according to the present embodiment, a center distance L is determined as follows. The center distance L is an extent of space from any one of the drive gears 104Y, 104M, 104C and 104K in the photoconductor drive unit 100 to a corresponding one of the photoconductor gears 21Y, 21M, 21C and 21K in the image forming apparatus 10. In other words, the center distance L is a distance between the shaft of the drive gear 104 and the shaft of the photoconductor gear 21. If the center distance L is too close to a target distance, a tip of a tooth or teeth of the drive gear 104 (i.e., the drive gears 104Y, 104M, 104C and 104K) contacts a root of a tooth or teeth of the photoconductor gear 21 (i.e., the photoconductor gears 21Y, 21M, 21C and 21K), or vice versa. This can cause abnormal wear or damage and/or an increase in load on driving of both the drive gear 104 and the photoconductor gear 21. Further, when the center distance L is too close to the target distance, vibration occurs when driving the gears. Consequently, image failure such as banding may be caused. By contrast, if the center distance L is too far from the target distance, vibration also occurs when driving the gears, and therefore image failure such as banding may be caused.

To address the above-described circumstance, the photoconductor drive unit 100 according to the present embodiment employs the configuration in which the photoconductor positioning member 101 and the drive gear holder 103 (i.e., the first drive gear holding member 103*a* and the second drive gear holding member 103*b*) are disposed at variable relative positions. In other words, the relative positions of the photoconductor positioning member 101 and the first drive gear holding member 103*a* and the second drive gear holding member 103*b* in the photoconductor drive unit 100 are adjustable. Further, when the photoconductor drive unit 100 is assembled, the relative position between the photoconductor positioning member 101 and the drive gear holder 103 (i.e., the first drive gear holding member 103*a* and the second drive gear holding member 103*b*) is adjusted so that the center distance L is set to be equal to the target distance. After adjustment of the relative position therebetween has been finished, the photoconductor positioning member 101 and the drive gear holder 103 (i.e., the first drive gear holding member 103*a* and the second drive gear holding member 103*b*) are fixed b screw to each other.

In the photoconductor drive unit 100 according to the present embodiment, the photoconductor center shaft 20 (i.e., the photoconductor center shafts 20Y, 20M, 20C and 20K) is held and positioned directly to a unit to which the drive gear 104 (i.e., the drive gears 104Y, 104M, 104C and 104K) is attached. Therefore, the photoconductor drive unit 100 having this configuration is less affected by accumulated errors due to processing accuracy and/or assembly error of parts included in the photoconductor drive unit 100 when compared with a configuration in which the photoconductor center shafts 20Y, 20M, 20C and 20K are supported by and positioned to the apparatus body of the image forming apparatus 10. In addition, the photoconductor 2 and the photoconductor center shaft 20 are directly positioned to the photoconductor drive unit 100. Accordingly, without providing a complicated mechanism such as a coupling mechanism, adverse effect to the photoconductor drive unit 100 caused by the accumulated errors as described above can be reduced.

Next, a description is given of the positioning of the drive motor 105 (i.e., the first drive motor 105*a* and the second drive motor 105*b*) in the photoconductor drive unit 100, with reference to FIG. 5.

As illustrated in FIG. 5, the photoconductor positioning member 101 includes a first drive source positioning portion 109*a* and a second drive source positioning portion 109*b* to be used for positioning the first drive motor 105*a* and the second drive motor 105*b*, respectively, to the photoconductor positioning member 101. Further, respective relay gear rotary shafts 116K, 116M and 116Y of the relay gears 106K, 106M and 106Y to be meshed with any one of the first output gear 115*a* and the second output gear 115*b* are supported by the photoconductor positioning member 101. According to this configuration, the respective center distances between the shaft of the respective output gears 115 (i.e., the first output gear 115*a* and the second output gear 115*b*) and the shaft of the corresponding relay gears 106 (i.e., the relay gears 106K, 106M and 106Y) are determined by the same part or member, and therefore the respective center distances can be determined with high accuracy. As a result, the driving forces from the drive motors 105 (i.e., the first drive motor 105*a* and the second drive motor 105*b*) can be transmitted to the relay gears 106 (i.e., the relay gears 106K, 106M and 106Y) accurately.

Figure 6:
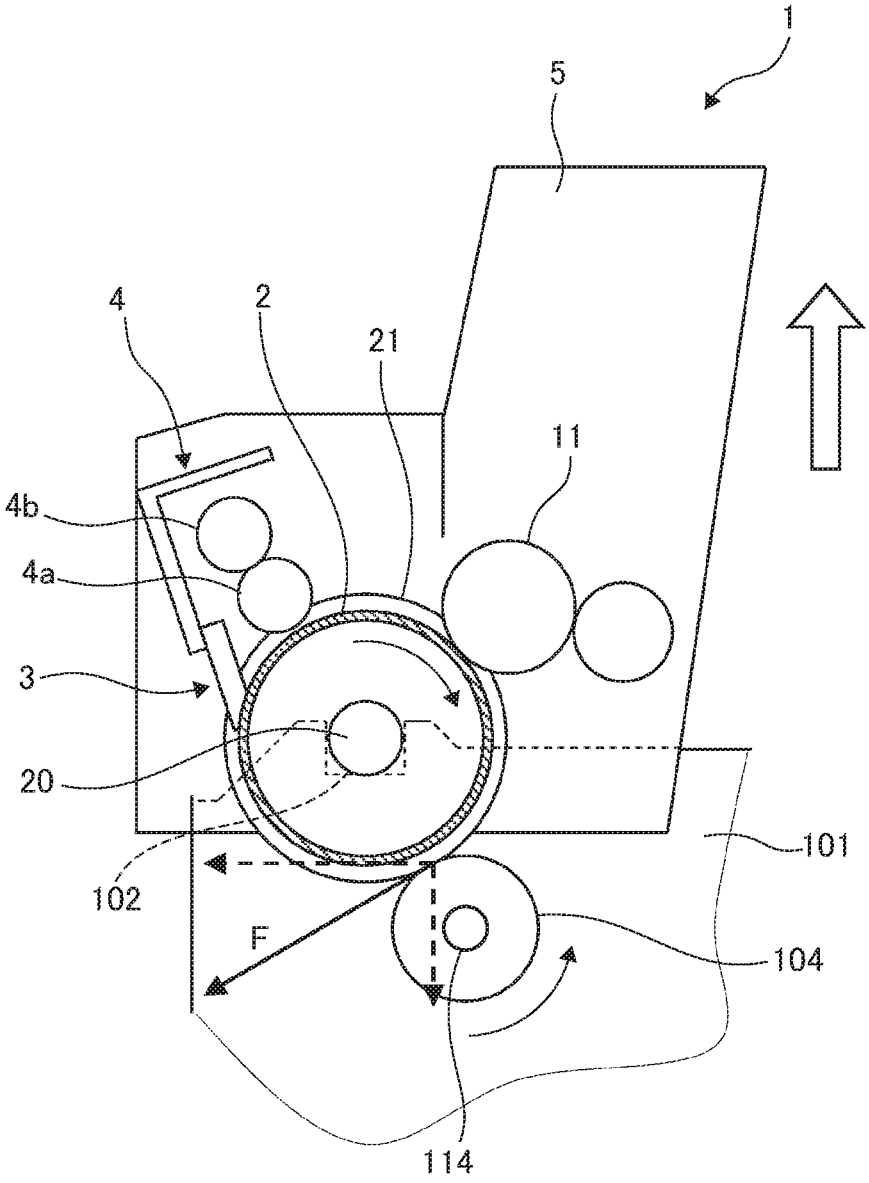
FIG. 6 is a diagram illustrating an image forming unit and the photoconductor drive unit, indicating that a tangential force having a component having a direction opposite to a removing direction of the image forming unit acts on a photoconductor gear when the photoconductor gear drives.

FIG. 6 is a diagram illustrating a tangential force F having a component in a direction opposite to a removing direction of the image forming unit 1 acts on the photoconductor gear 21 when the photoconductor gear 21 receives the driving force from the drive gear 104. An arrow directing in an upward direction in FIG. 6 indicates a removing direction of the image forming unit 1.

To enhance printing quality of the image forming apparatus 10, the photoconductors 2Y, 2M, 2C and 2K are maintained at the respective positions during the printing operation without leaving from the photoconductor positioning portions 102Y, 102M, 102C and 102K, that is, the photoconductors 2Y, 2M, 2C and 2K contact the intermediate transfer belt 16 stably.

As illustrated in FIG. 6, in the configuration of the image forming apparatus 10 according to the present embodiment, the photoconductor gear 21 (i.e., the photoconductor gears 21Y, 21M, 21C and 21K) and the drive gear 104 (i.e., the drive gears 104Y, 104M, 104C and 104K) are so disposed that the tangential force F that has a component opposite to the removing direction to which the image forming unit 1 (i.e., the image forming units 1Y, 1M, 1C and 1K) is detached is applied to the photoconductor gear 21 when the photoconductor gear 21 receives a driving force transmitted by the drive gear 104. By so doing, when the photoconductor gear 21 is meshed with the drive gear 104 and receives the driving force transmitted by the drive gear 104, the photoconductor center shaft 20 is pressed against the photoconductor positioning portion 102. Accordingly, the image forming unit 1 is prevented from lifting up while the photoconductor 2 is rotating.

According to this configuration, the parts or units used to drive to rotate the photoconductors 2Y, 2M, 2C and 2K are also used to prevent the image forming units 1Y, 1M, 1C and 1K from rising from the photoconductor positioning member 101. As a result, the number and layout of parts to be employed for preventing the image forming units 1Y, 1M, 1C and 1K from lifting up from the photoconductor positioning member 101 can be reduced to the minimum.

Figure 7:
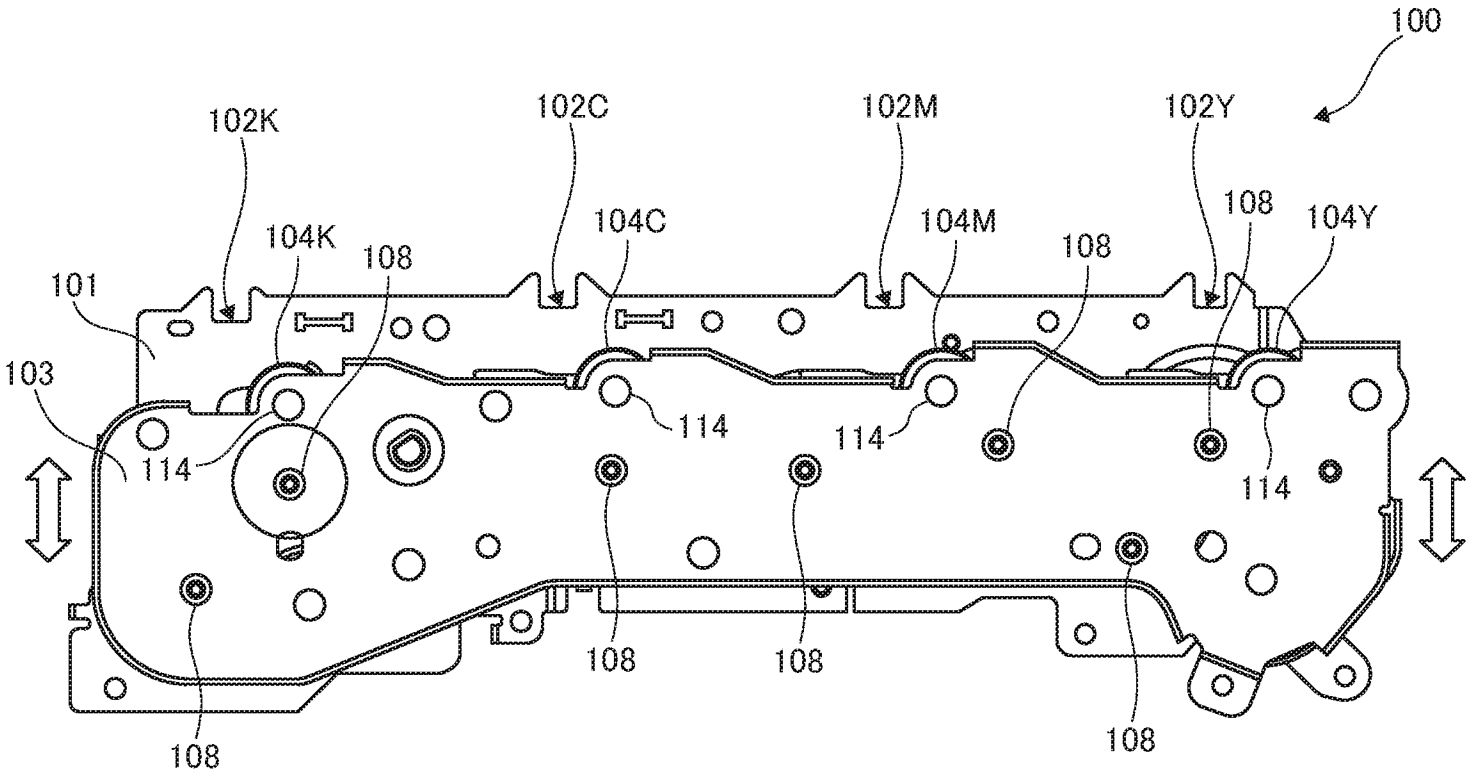
FIG. 7 is a diagram illustrating drive unit adjusters provided to the photoconductor drive unit.
Figure 8A:
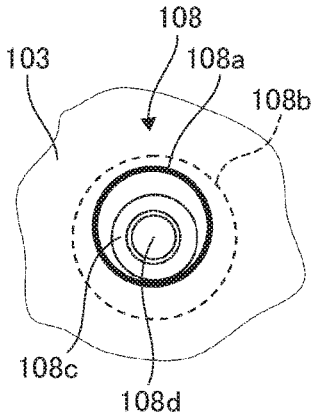
FIGS. 8A through 8C are enlarged views illustrating one of the drive unit adjusters and units around the drive unit adjuster.
Figure 8B:
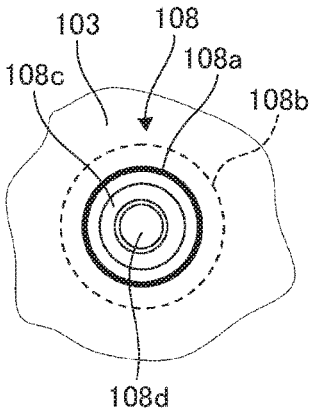
Figure 8C:
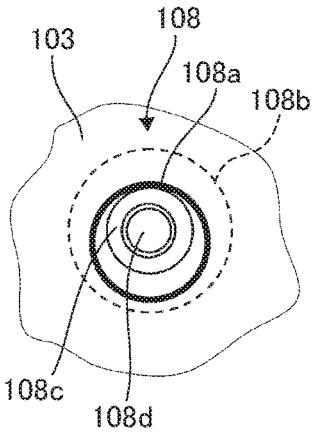
Figure 9A:
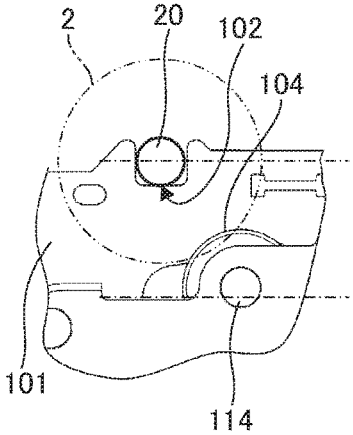
FIGS. 9A through 9C are diagrams illustrating a distance between shafts of the photoconductor gear and the drive gear.
Figure 9B:
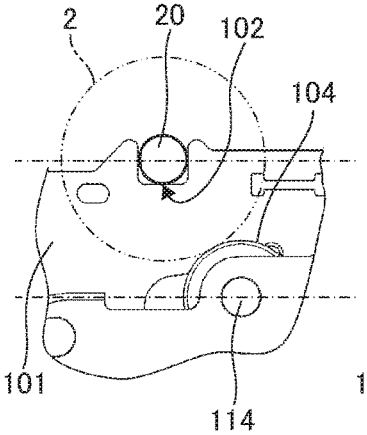
Figure 9C:
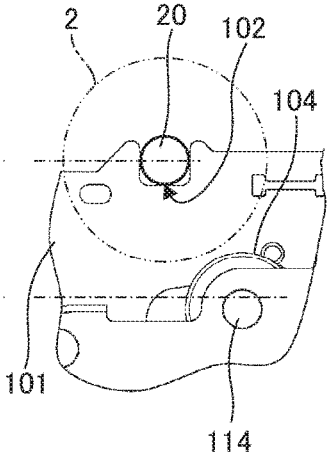

FIG. 7 is a diagram illustrating drive unit adjusters 108 provided to the photoconductor drive unit 100. FIGS. 8A through 8C are enlarged views illustrating one of the drive unit adjusters 108 and units around the drive unit adjuster 108. FIGS. 9A through 9C are diagrams illustrating the center distance L (see FIG. 1) between the shaft of the photoconductor gear 21 and the shaft of the drive gear 104.

The drive unit adjusters 108 are provided to the photoconductor drive unit 100. Each of the drive unit adjusters 108 includes an adjustment opening 108*a*, an adjustment shaft 108*b*, and an adjustment boss 108*c* including an opening 108*d*. The adjustment openings 108*a* are formed on the drive gear holder 103 including the first drive gear holding member 103*a* and the second drive gear holding member 103*b*. The adjustment shaft 108*b* is formed on the photoconductor positioning member 101. The adjustment boss 108*c* is provided to the tip of the adjustment shaft 108*b*. The opening 108*d* is formed at the center of the adjustment boss 108*c* for fixing a screw. It is to be noted that the adjustment shaft 108*b* in whole or in part thereof also functions as a center shaft of the relay gear 106.

Now, FIGS. 8A through 8C, and 9A through 9C show the drive unit adjuster 108 after adjustment of the relative positions of the photoconductor positioning member 101 and the drive gear holder 103 including the first drive gear holding member 103*a* and the second drive gear holding member 103*b*, and another state in which the center distance L between the shaft of the drive gear 104 and the shaft of the photoconductor gear 21.

FIGS. 8B and 9B show that the center distance L between the shaft of the drive gear 104 and the shaft of the photoconductor gear 21 is in a normal state. That is, a pitch circle of the drive gear 104 and a pitch circle of the photoconductor gear 21 are disposed in contact with each other. In case of changing the center distance L from the normal state for some reasons, the adjustment boss 108*c* is shifted with respect to the adjustment opening 108*a*. By so doing, the relative position between the photoconductor positioning member 101 and the drive gear holder 103 changes. The photoconductor positioning member 101 supports and positions the photoconductor center shaft 20. The drive gear holder 103 includes the first drive gear holding member 103*a* and the second drive gear holding member 103*b* to which the drive gear 104 is attached. Accordingly, the center distance L can be adjusted.

FIG. 8A shows a positional relation of the adjustment opening 108*a* and the adjustment boss 108*c* in the state in which the center distance L is approached from the normal state. By contrast, FIG. 8C shows a positional relation of the adjustment opening 108*a* and the adjustment boss 108*c* in the state in which the center distance L is separated from the normal state.

In FIGS. 8A through 8C, the center distance L is adjusted by shifting the adjustment boss 108*c* in a vertical direction with respect to the adjustment opening 108*a*. However, a moving direction of the shafts is not limited thereto. For example, the center distance L can be adjusted by shifting the adjustment boss 108*c* in a horizontal direction.

After adjustment of the relative position between the photoconductor positioning member 101 and the drive gear holder 103 including the first drive gear holding member 103*a* and the second drive gear holding member 103*b*, the photoconductor positioning member 101 and the drive gear holder 103 including the first drive gear holding member 103*a* and the second drive gear holding member 103*b* are attached to each other by screws through the opening 108*d* provided to the adjustment boss 108*c*. Thus, the photoconductor positioning member 101 and the drive gear holder 103 including the first drive gear holding member 103*a* and the second drive gear holding member 103*b* are fixed to each other. Accordingly, assembly of the photoconductor drive unit 100 is completed.

As described above, by using the same shaft to function for adjusting the relative positions of the photoconductor positioning member 101 and the drive gear holder 103 (i.e., the first drive gear holding member 103*a* and the second drive gear holding member 103*b*), rotating the gears such as the drive gear 104 and the photoconductor gear 21, and fixing the photoconductor positioning member 101 and the drive gear holder 103 (i.e., the first drive gear holding member 103*a* and the second drive gear holding member 103*b*), the photoconductor drive unit 100 can be assembled with high accuracy with the minimum number of parts and components.

Figure 10A:
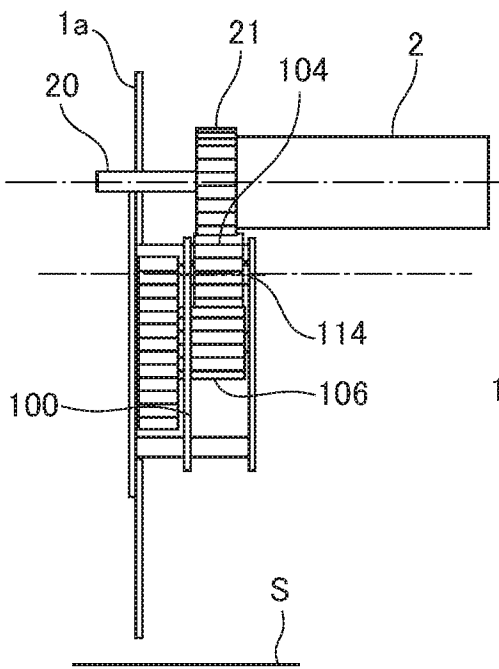
FIGS. 10A through 10C are cross sectional views illustrating a state in which the photoconductor drive unit and the photoconductor are attached to the image forming apparatus, viewed from a front of the image forming apparatus.
Figure 10B:
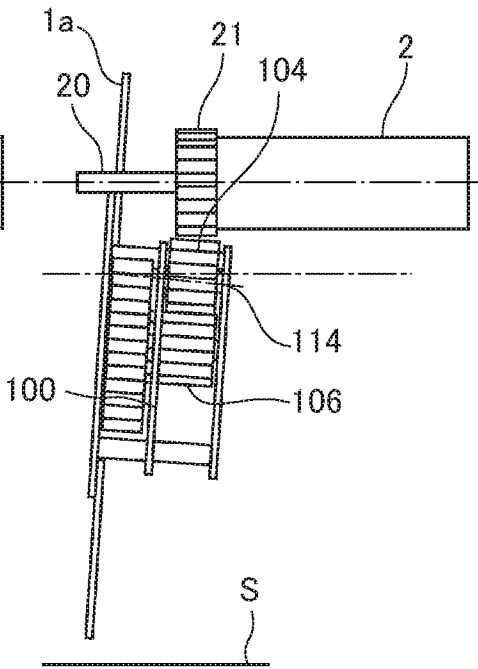
Figure 10C:
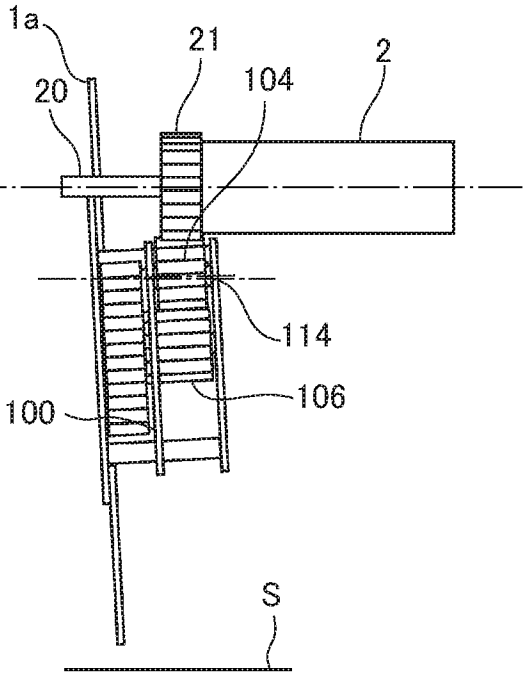

Next, a description is given of changes in distance between the drive gear 104 and the photoconductor gear 21 depending on a frame condition of the apparatus body of the image forming apparatus 10, with reference to FIGS. 10A through 10C.

FIGS. 10A through 10C are cross sectional views illustrating a state in which the photoconductor drive unit 100 and the photoconductor 2 are attached to the image forming apparatus 10, viewed from a front of the image forming apparatus 10 (from the right side of FIG. 2). It is to be noted that reference letter "S" in FIGS. 10A through 10C indicates an installation surface such as a floor on which the image forming apparatus 10 is installed and a top face of a desk.

As illustrated in FIGS. 10A through 10C, the image forming apparatus 10 includes a side panel frame 1*a* in the apparatus body thereof. If there is no processing accuracy error and/or assembly error, the side panel frame 1*a* stands on the installation surface S straight in a direction perpendicular to the installation surface, as illustrated in FIG. 10A.

However, if the side panel frame 1*a* has any processing accuracy error and/or assembly error, the side panel frame 1*a* may be disposed in a tilted manner with respect to the installation surface S, as illustrated in FIGS. 10B and 10C. At this time, the parallelism is lost between the photoconductor drive unit 100 and the photoconductor 2, as illustrated in FIGS. 10B and 10C. As a result, the center distance L between the shaft of the drive gear 104 and the shaft of the photoconductor gear 21 becomes far from the target distance, as shown in FIG. 10B, or close to the target distance, as shown in FIG. 10C.

To address the above-described circumstance, the photoconductor drive unit 100 having the configuration shown in FIGS. 7, 8A through 8C, and 9A through 9C can be applied to correct the center distance L of the shaft of the drive gear 104 and the shaft of the photoconductor gear 21.

Specifically, when assembling the photoconductor drive unit 100, the relative position of the photoconductor positioning member 101 and the drive gear holder 103 (i.e., the first drive gear holding member 103*a* and the second drive gear holding member 103*b*) can be changed while adjusting the center distance L between the shaft of the photoconductor gear 21 and the shaft of the drive gear 104 to be equal to the target distance. Therefore, the photoconductor drive unit 100 can be assembled while adjusting the center distance L. Accordingly, the photoconductor gear 21 and the drive gear 104 can be prevented from being assembled while the center distance L between the shaft of the photoconductor gear 21 and the shaft of the drive gear 104 is out of the target distance due to processing accuracy error and/or assembly error of the parts in the image forming apparatus 10. If the center distance L between the shaft of the photoconductor gear 21 and the shaft of the drive gear 104 becomes different from the target distance, that is, if the center distance L becomes far from or close to the target distance, vibration is created when the photoconductor gear 21 and the drive gear 104 are driven to rotate. Consequently, image failure such as banding may be caused due to the vibration. The configuration of the photoconductor drive unit 100 can prevent such image failure due to vibration. Further, the photoconductor gear 21 and the drive gear 104 can be free from abnormal wear or damage and/or an increase in load on driving thereof caused by the center distance L being set to be close to the target distance.

Next, a description is given of adjustment of the relative position of the photoconductor positioning member 101 and the drive gear holder 103 including the first drive gear holding member 103*a* and the second drive gear holding member 103*b* with a positioning tool 200.

Figure 11:
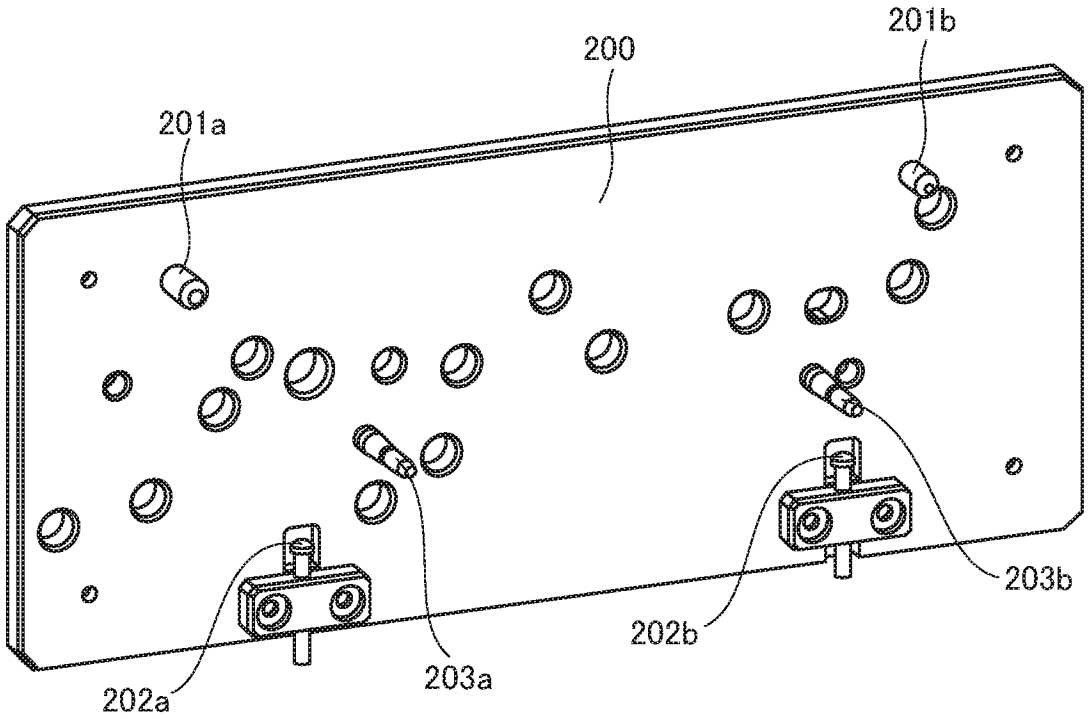
FIG. 11 is a perspective view illustrating an outer appearance of a positioning tool.
Figure 12:
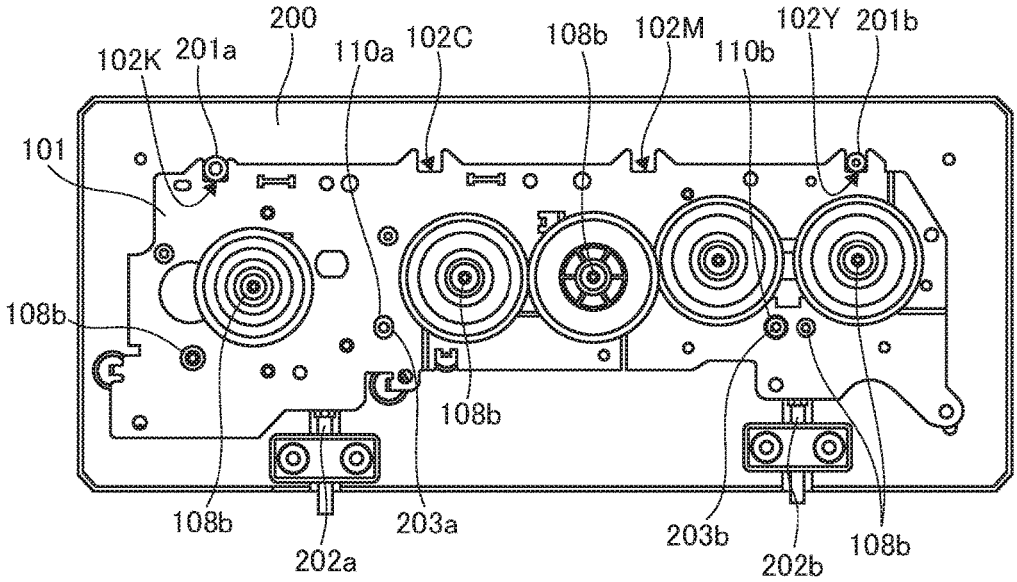
FIG. 12 is a diagram illustrating a state in which a photoconductor positioning member is attached to the positioning tool.
Figure 13:
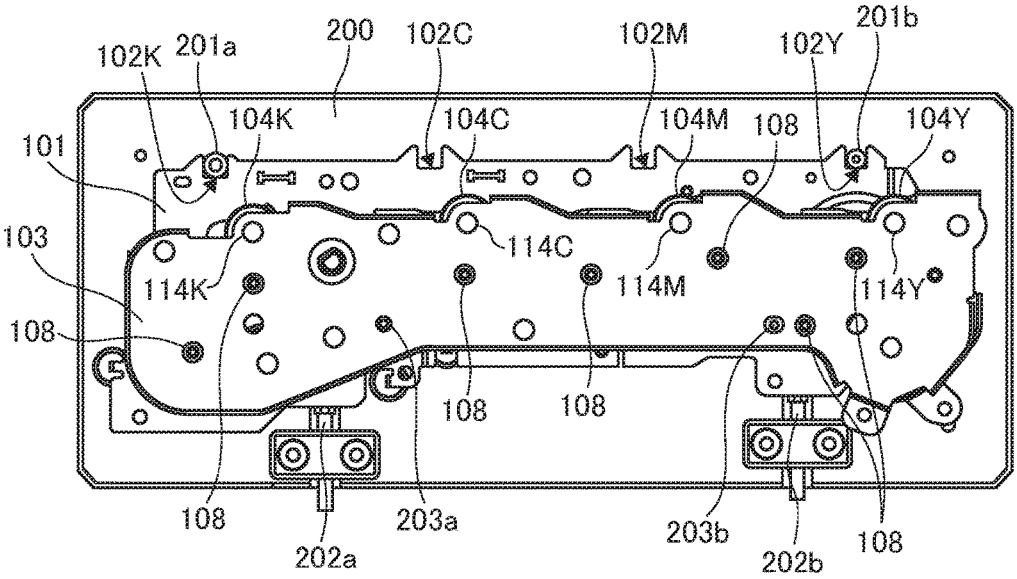
FIG. 13 is a diagram illustrating a state in which the photoconductor positioning member and drive gear holders are attached to the positioning tool.

FIG. 11 is a perspective view illustrating an outer appearance of a positioning tool 200. FIG. 12 is a diagram illustrating a state in which the photoconductor positioning member 101 is attached to the positioning tool 200. FIG. 13 is a diagram illustrating a state in which the photoconductor positioning member 101 and the drive gear holder 103 (i.e., the first drive gear holding member 103*a* and the second drive gear holding member 103*b* are attached to the positioning tool 200.

As illustrated in FIG. 11, the positioning tool 200 that functions as a fitting tool includes a first reference pin 201*a*, a second reference pin 201*b*, a first biasing member 202*a*, a second biasing member 202*b*, a first retaining pin 203*a* and a second retaining pin 203*b*. The reference pins 201 (i.e., the first reference pin 201*a* and the second reference pin 201*b*), each of which functions as a contact body, are members to position the photoconductor positioning member 101 on the positioning tool 200. The biasing members 202 (i.e., the first biasing member 202*a* and the second biasing member 202*b*) are members to bias the photoconductor positioning member 101 toward the reference pins 201 (i.e., the first reference pin 201*a* and the second reference pin 201*b*). The retaining pins 203 (i.e., the first retaining pin 203*a* and the second retaining pin 203*b*), each of which functions as a positioning body, are members to hold and position the drive gear holder 103 (i.e., the first drive gear holding member 103*a* and the second drive gear holding member 103*b*). The first reference pin 201*a* has the same diameter as that of the photoconductor center shaft 20. The second reference pin 201*b* has a diameter smaller than the first reference pin 201*a*.

In assembling the photoconductor drive unit 100, the photoconductor positioning member 101 is firstly positioned to the positioning tool 200 with the first reference pin 201*a*, the second reference pin 201*b*, the first biasing member 202*a* and second biasing member 202*b*, as illustrated in FIG. 12.

The drive gear holder 103 (i.e., the first drive gear holding member 103*a* and the second drive gear holding member 103*b*) are provided with a first positioning hole 110*a* and a second positioning hole 110*b*, respectively, functioning as positioning openings through which the first retaining pin 203*a* and the second retaining pin 203*b* of the positioning tool 200 are inserted, respectively.

In the state in which the photoconductor positioning member 101 is positioned to the positioning tool 200, as the retaining pins 203 (i.e., the first retaining pin 203*a* and the second retaining pin 203*b*) are inserted into the positioning holes 110 (i.e., the first positioning hole 110*a* and the second positioning hole 110*b*), respectively, the drive gear holder 103 (i.e., the first drive gear holding member 103*a* and the second drive gear holding member 103*b*) are set onto the positioning tool 200.

The reference pins 201 (i.e., the first reference pin 201*a* and the second reference pin 201*b*) and the retaining pins 203 (i.e., the first retaining pin 203*a* and the second retaining pin 203*b*) are disposed on the positioning tool 200 such that the center distance L between the shaft of the photoconductor gear 21 and the shaft of the drive gear 104 can be set to the target distance when the photoconductor positioning member 101 and the drive gear holder 103 (i.e., the first drive gear holding member 103*a* and the second drive gear holding member 103*b*) are set to the positioning tool 200.

With the photoconductor positioning member 101 and the drive gear holder 103 (i.e., the first drive gear holding member 103*a* and the second drive gear holding member 103*b*) being set to the positioning tool 200, the photoconductor positioning member 101 and the drive gear holder 103 (i.e., the first drive gear holding member 103*a* and the second drive gear holding member 103*b*) are screwed with the opening 108*d* provided to the drive unit adjuster 108. By so doing, the respective relative positions are fixed, and therefore the center distance L between the shaft of the photoconductor gear 21 and the shaft of the drive gear 104 can be maintained to the target distance. Thus, by using the positioning tool 200 in assembly of the photoconductor drive unit 100, the assembly can be performed with high accuracy in positioning.

Alternatively, the positioning tool 200 can be an inserting type tool in which the reference pins 201 (i.e., the first reference pin 201*a* and the second reference pin 201*b*) are detachably attachable to a body of the positioning tool 200. With this structure, the reference pins 201 (i.e., the first reference pin 201*a* and the second reference pin 201*b*) can be replaced easily. In this configuration, without changing the sizes of the reference pins 201 (i.e., the first reference pin 201*a* and the second reference pin 201*b*) in a horizontal direction in FIGS. 12 and 13, the sizes thereof in a vertical direction in the drawings can be changed by replacement of the reference pins 201 (i.e., the first reference pin 201*a* and the second reference pin 201*b*). By so doing, the relative position of the photoconductor positioning member 101 and the drive gear holder 103 (i.e., the first drive gear holding member 103*a* and the second drive gear holding member 103*b*) is adjusted. Accordingly, the center distance L between the shaft of the photoconductor gear 21 and the shaft of the drive gear 104 can be finely adjusted.

Figure 14:
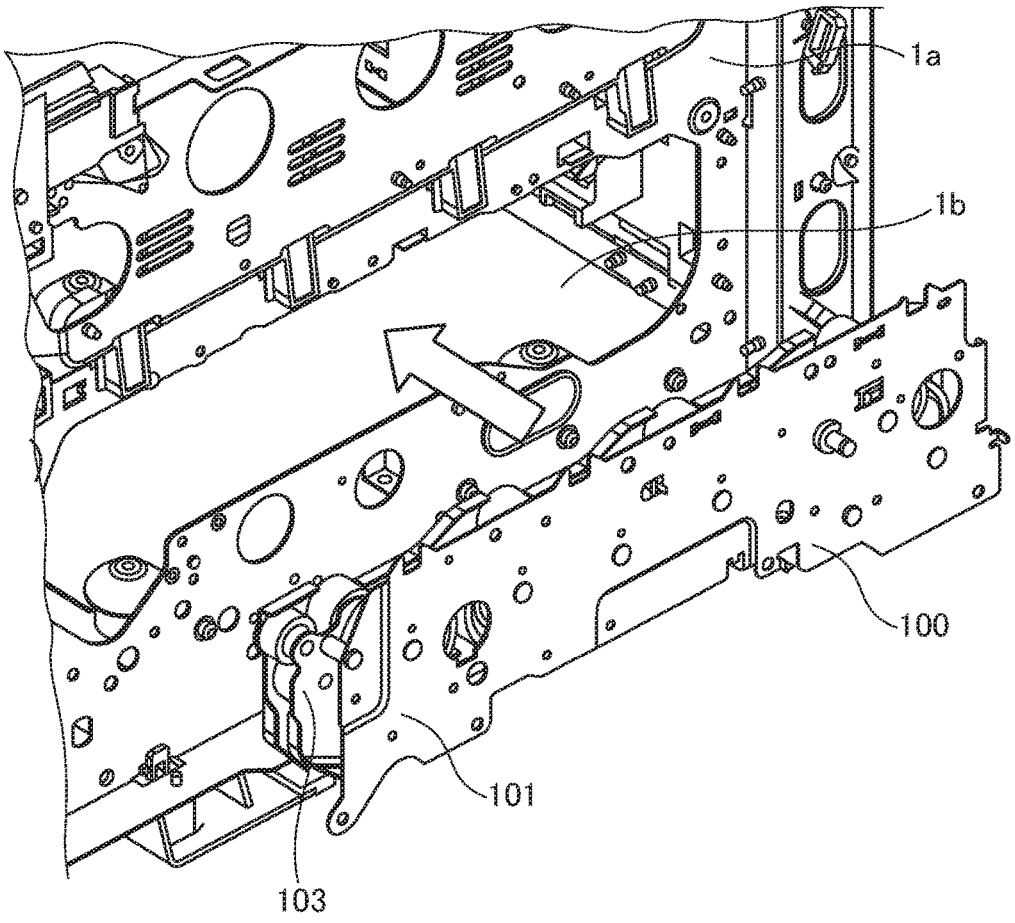
FIG. 14 is a diagram illustrating how to attach the photoconductor drive unit to the image forming apparatus.

Next, a description is given of attachment of the photoconductor drive unit 100 to the apparatus body of the image forming apparatus 10, with reference to FIG. 14. FIG. 14 is a diagram illustrating how to attach the photoconductor drive unit 100 to the image forming apparatus 10.

As illustrated in FIG. 14, the side panel frame 1*a* of the apparatus body of the image forming apparatus 10 has an opening 1*b*. The opening 1*b* of the side panel frame 1*a* is greater than an external form of the drive gear holder 103 (i.e., the first drive gear holding member 103*a* and the second drive gear holding member 103*b*) provided in the photoconductor drive unit 100. When attaching the photoconductor drive unit 100 to the apparatus body of the image forming apparatus 10, the drive gear holder 103 (i.e., the first drive gear holding member 103*a* and the second drive gear holding member 103*b*) are inserted into the image forming apparatus 10 through the opening 1*b*. Then, the photoconductor positioning member 101 is fixed with screw to the side panel frame 1*a*, for example. With this configuration, the photoconductor drive unit 100 can be replaced and attached to the apparatus body of the image forming apparatus 10 with a direct access thereto from outside the apparatus body of the image forming apparatus 10. Accordingly, the performance in service and maintenance of the image forming apparatus 10 can be enhanced.

In a case in which either one of the photoconductor positioning member 101 and the drive gear holder 103 (i.e., the first drive gear holding member 103*a* and the second drive gear holding member 103*b*) is formed integrally with the apparatus body of the image forming apparatus 10, when the center distance L between the shaft of the photoconductor gear 21 and the shaft of the drive gear 104 is adjusted, an operator hugs the apparatus body of the image forming apparatus 10 to proceed the adjustment, which results in poor working performance.

By contrast, the image forming apparatus 10 according to the present embodiment employs the configuration in which the photoconductor drive unit 100 having the photoconductor positioning member 101 and the drive gear holder 103 (i.e., the first drive gear holding member 103*a* and the second drive gear holding member 103*b*) integrally provided is detachably attachable to the apparatus body of the image forming apparatus 10. According to this configuration, the operator can easily adjust the center distance L at a different place from the apparatus body of the image forming apparatus 10.

As described above, when the center distance L becomes close to or far from the target distance, vibration occurs when driving the gears. However, as a result of intensive studies, it was found that the acceptable range to the target distance is narrower when the center distance L is close to the target distance than the acceptable range when the center distance L is far from the target distance. Consequently, even after the center distance L has been set to be equal to the target distance, if the center distance L comes closer to the target distance when the photoconductor gear 21 and the drive gear 104 are driven to rotate, vibration occurs when driving the gears, and therefore image failure such as banding may be caused.

Figure 15:
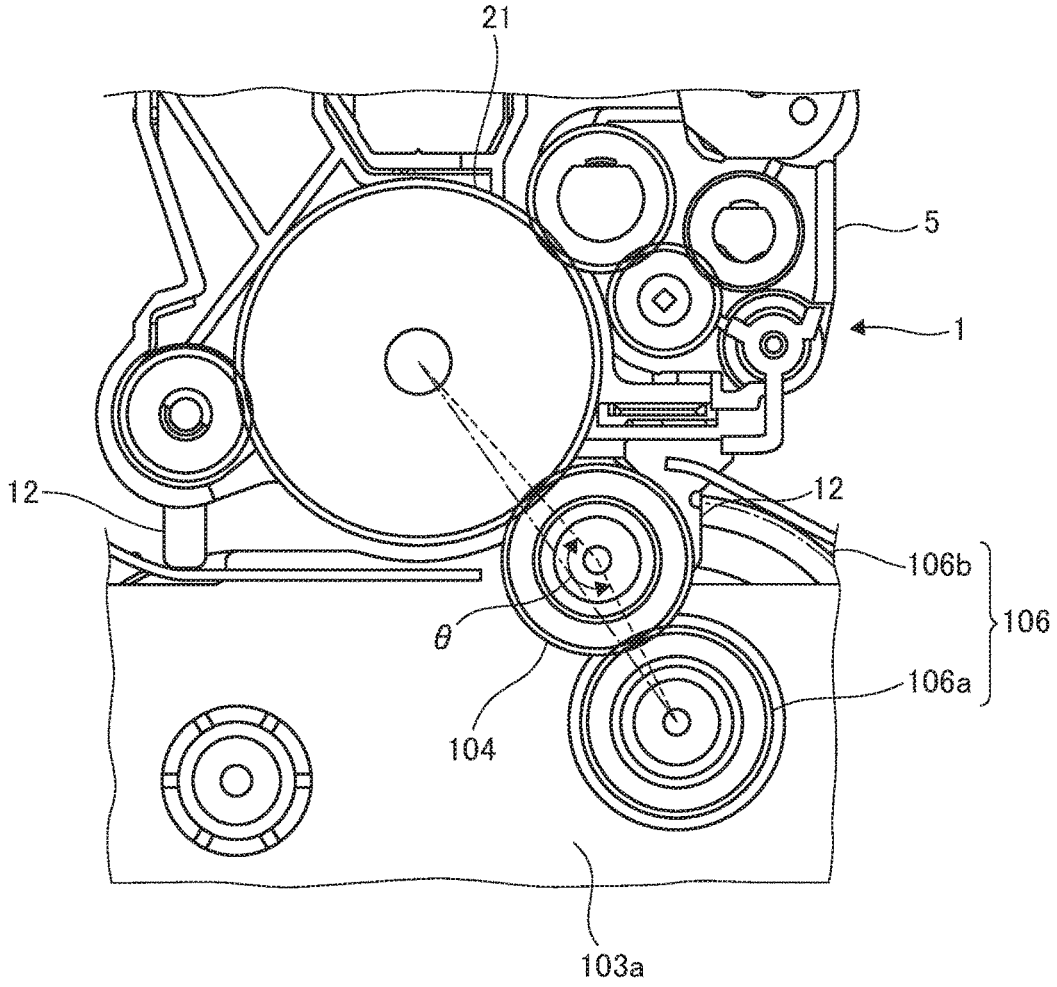
FIG. 15 is an enlarged view illustrating a layout of gears transmitting the driving force from a relay gear to the photoconductor gear, according to the present embodiment of this disclosure.

Next, a description is given of a configuration of the image forming apparatus 10 according to the present embodiment of this disclosure, which prevents occurrence of this inconvenience, with reference to FIGS. 1 and 15.

FIG. 15 is an enlarged view illustrating a layout of gears that transmit a driving force from the relay gear 106 to the photoconductor gear 21 in the image forming apparatus 10 according to the present embodiment of this disclosure.

As described with reference to FIGS. 1 and 5, three photoconductors 2, which are the photoconductor 2Y, the photoconductor 2M and the photoconductor 2C, share the second drive motor 105*b* as a common drive source to transmit a driving force applied thereby. The centers of rotations of three drive gears 104Y, 104M and 104C to transmit the driving forces to the photoconductors 2Y, 2M and 2C, respectively, are located as follows. That is, relative to a virtual line segment connecting the center of rotation of the relay gear 106 (i.e., the relay gears 106Y, 106M and 106C) connected to the drive gear 104 (i.e., the drive gears 104Y, 104M and 104C) and the center of rotation of the photoconductor gear 21 (i.e., the photoconductor gears 21Y, 21M and 21C), the center of rotation of the drive gear 104 is located downstream from the center of rotation of the relay gear 106 in the rotation direction.

When the gears are driven, the tooth or teeth of the drive gear 104 is pressed against the tooth or teeth of the relay gear 106 at a portion where the drive gear 104 and the relay gear 106 are connected to each other (i.e., the meshing portion of the teeth of the drive gear 104 and the teeth of the relay gear 106). Therefore, at the portion where the drive gear 104 and the relay gear 106 are coupled with each other, the drive gear 104 receives a force to move toward a downstream side of the rotation direction of the relay gear 106.

Further, the tooth or teeth of the drive gear 104 presses the tooth or teeth of the photoconductor gear 21 at the connecting portion of the drive gear 104 and the photoconductor gear 21, and therefore a force half of the pressing force of the drive gear 104 pressing the photoconductor gear 21 acts on the tooth or teeth of the drive gear 104 at the connecting portion. Therefore, at the portion where the drive gear 104 and the photoconductor gear 21 are connected to each other, the drive gear 104 receives a force to move toward the upstream side of the rotation direction of the photoconductor gear 21.

Each resultant force of the force acting at the connecting portion of the drive gear 104 and the relay gear 106 and the force acting at the connecting portion of the drive gear 104 and the photoconductor gear 21 is indicated by arrows in FIG. 1, which are arrows "FY", "FM", "FC", and "FK".

Then, by locating the center of rotation of the drive gear 104 to the virtual line segment indicated by a broken line in FIGS. 1 and 15 at the downstream side in the rotation direction of the relay gear 106, the center of rotation of the drive gear 104 to the virtual line segment is set to the position in a direction of the resultant force that acts when the gears are driven. When the gears are driven by the drive motor 105 in this location, the center of rotation of the drive gear 104 shifts in the direction to separate from the virtual line segment. The distance of the relay gear 106 and the photoconductor gear 21 is shortest at the position of the virtual line segment. Therefore, as the drive gear 104 separates from the virtual line segment, the drive gear 104 moves to separate from the closest position of the relay gear 106 and the photoconductor gear 21. Accordingly, the center distance L of the shaft of the drive gear 104 and the shaft of the photoconductor gear 21 increases.

Figure 18:
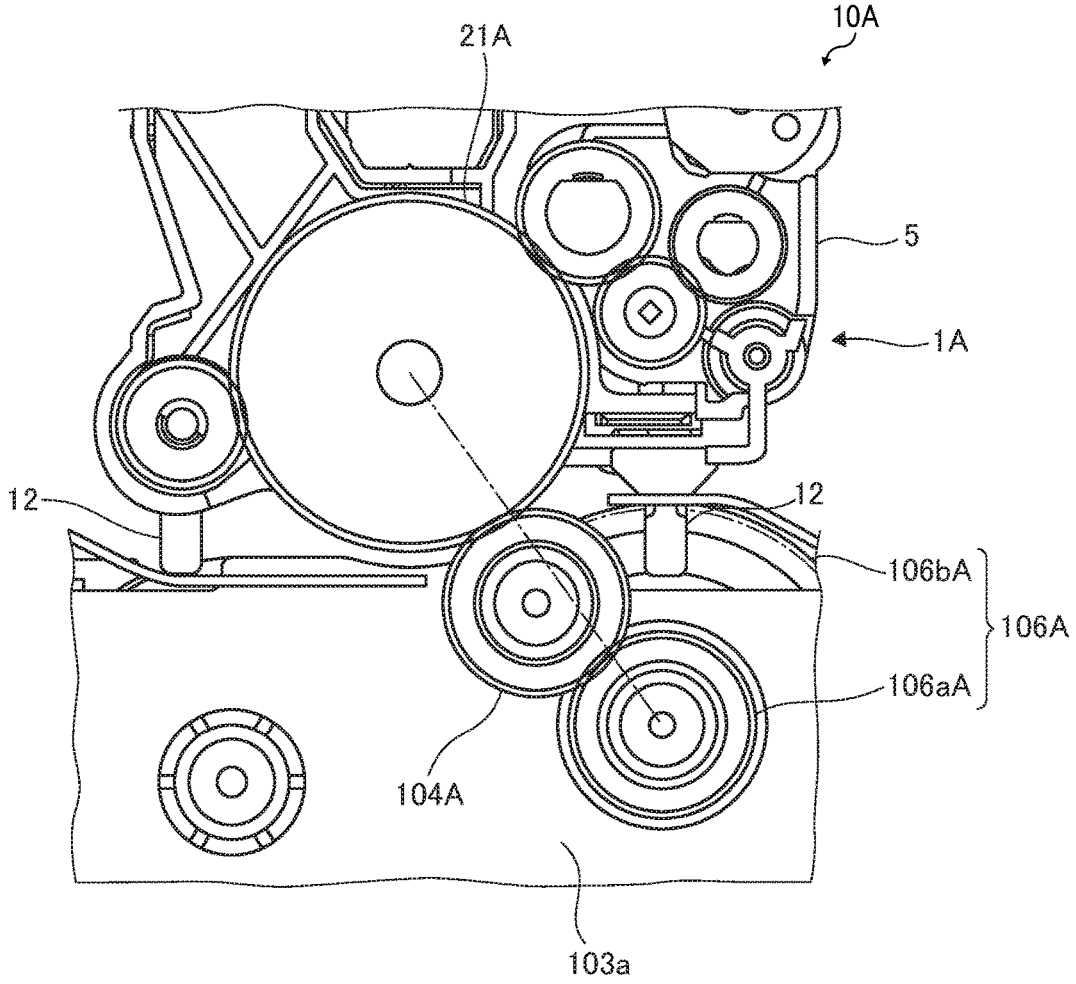
FIG. 18 is an enlarged view illustrating a layout of gears transmitting a driving force from a relay gear to a photoconductor gear in a comparative image forming apparatus.

FIG. 18 is an enlarged view illustrating a layout of gears transmitting a driving force from a relay gear 106A including a small diameter gear 106*a*A and a large diameter gear 106*b*A to a photoconductor gear 21A in an image forming unit 1A of a comparative image forming apparatus 10A.

In the layout of gears illustrated in FIG. 18, relative to a virtual line segment (i.e., a line segment indicated by a broken line in FIG. 18) connecting the center of rotation of the relay gear 106A coupled to a drive gear 104A and the center of rotation of the photoconductor gear 21A, the center of rotation of the drive gear 104A is located upstream side from the center of rotation of the relay gear 106A in the rotation direction. In this case, the virtual line segment to the center of rotation of the drive gear 104A is located in a direction of the resultant force that acts when the gears are driven. When the gears are driven by a drive motor 105A in this location, the center of rotation of the drive gear 104A shifts in the direction to approach the virtual line segment. Therefore, as the drive gear 104A approaches the virtual line segment, the drive gear 104A moves to bite or cut in the closest position of the relay gear 106A and the photoconductor gear 21A, and therefore the center distance L between the drive gear 104A and the photoconductor gear 21A decreases.

As described above, the acceptable range of the center distance L to the target distance is narrower with the center distance L closer to the target distance, than with the center distance L farther to the target distance. If the center distance L becomes smaller than the acceptable range to the target distance, a tip of a tooth or teeth of the drive gear 104A contacts a root of a tooth or teeth of the photoconductor gear 21A, or vice versa. This can cause abnormal wear or damage and/or an increase in load on driving of both the drive gear 104A and the photoconductor gear 21A. Further, due to contact of the tip of tooth or teeth of the drive gear 104A or the photoconductor gear 21A and the root of tooth or teeth of the drive gear 104A or the photoconductor gear 21A, the drive gear 104A and the photoconductor gear 21 can be worn easily, and therefore the service lives thereof expire sooner. Therefore, when the gears are located as illustrated in FIG. 18, as the center distance L becomes closer to the target distance, vibration occurs even if the drive gear 104A is shifted due to the driving of the photoconductor gear 21A and the drive gear 104A. Therefore, image failure such as banding may be caused due to the vibration.

Hereinafter, as illustrated in FIG. 18, a layout in which the drive gear 104A moves to bite or cut in to the closest position of the relay gear 106 and the photoconductor gear 21 when the gears are driven is referred to as a "bite type layout."

By contrast, the image forming apparatus 10 according to the present embodiment of this disclosure has the layout of gears as illustrated in FIGS. 1 and 15. Therefore, when the second drive motor 105*b* is driven, the three center distances L become farther from the target distance. Consequently, the center distances L are prevented from being close to the target value when the gears are driven, therefore the vibration of gears due to the closer distance of the center distances L are prevented. Accordingly, image failure such as banding caused due to the vibration can be prevented. Further, as described above, when the center distance L becomes farther from the target distance, a margin is given to the acceptable range. Therefore, when the drive gear 104 is shifted due to the driving of the gears, even if the center distance L is separated from the target distance, no vibration occurs. Accordingly, no vibration is generated, and therefore, image failure such as banding can be prevented. Further, due to the separation of the center distance L from the target distance, the tip and the root of the gears come to separate from each other when the gears are driven due to backlash of the inner diameter of the gears. Consequently, the contact of the tip and the root of the gears can be prevented, abnormal wear of the drive gear 104 and the photoconductor gear 21 can be restrained, and a reduction in service life of each part can be prevented.

Hereinafter, as illustrated in FIG. 15, a layout in which the drive gear 104 separates from the closest position of the relay gear 106 and the photoconductor gear 21 when the gears are driven is referred to as a "relief type layout."

A reference symbol "(theta)" indicates a relative angle that is formed at the center of rotation of the drive gear 104 by two virtual line segments (i.e., broken lines in FIG. 15), one of which extending toward the center of rotation of the drive gear 104 from the center of rotation of the photoconductor gear 21 and the other of which extending toward the center of rotation of the drive gear 104 from the center of rotation of the relay gear 106. The relative angle (theta) can be set to any degree in a range that satisfies the above-described condition(s) with respect to the locations of the relay gear 106, the drive gear 104 and the photoconductor gear 21. Therefore, the image forming apparatus 10 has high flexibility of layout and can include the image forming unit 1 in a space saving environment, and therefore can achieve a reduction in size thereof.

In the image forming apparatus 10, the relay gear 106C of the four relay gears 106Y, 106M, 106C and 106K is a gear to receive a driving force from the second drive motor 105*b* via the relay gear 106M and the drive distributing relay gear 107. In addition, the center of rotation of the drive gear 104M, which is connected to the relay gear 106M of the four drive gears 104Y, 104M, 104C and 104K, is located as follows. Specifically, relative to a virtual line segment (i.e., a line segment indicated by a broken line in FIG. 1) connecting the center of rotation of the relay gear 106M and the center of rotation of the photoconductor gear 21M, the center of rotation of the drive gear 104M is located downstream from the center of rotation of the relay gear 106M in the rotation direction.

When the gears are driven by the second drive motor 105*b* in this location, the center of rotation of the drive gear 104M shifts in the direction to separate from the virtual line segment. The distance of the relay gear 106M and the photoconductor gear 21M becomes shortest at the position of the virtual line segment. Therefore, as the drive gear 104M separates from the virtual line segment, the drive gear 104M moves to separate from the closest position of the relay gear 106M and the photoconductor gear 21M. Accordingly, a center distance of the shaft of the drive gear 104M and the shaft of the relay gear 106M increases.

The relay gear 106M transmits the driving force to the image forming unit 1M and the image forming unit 1C. Therefore, the driving load of two image forming units 1M and 1C is applied to the relay gear 106M, which is the largest load to act on the four relay gears 106Y, 106M, 106C and 106K while driving. Consequently, the relay gear 106M is worn most among the four relay gears 106Y, 106M, 106C and 106K, and therefore the service life thereof becomes shortest. If the relay gear 106M and the drive gear 104M connected to the relay gear 106M are disposed in the bite type layout as the relay gear 106A and the drive gear 104A in the comparative image forming apparatus 10A, as illustrated in FIG. 18, the tip of the tooth or teeth of the drive gear 104M contacts the root of the tooth or teeth of the relay gear 106M, or vice versa. If the above-described contact of the tip of a gear and the root of a mating gear occurs, both the drive gear 104M and the relay gear 106M can be worn easily, and therefore the wear of the relay gear 106M, which is worn most quickly among the four relay gears 106Y, 106M, 106C and 106K, is more accelerated.

By contrast, in the image forming apparatus 10 according to the present embodiment, the center distance of the shaft of the drive gear 104M and the shaft of the relay gear 106M becomes greater or increases. Therefore, the wear of the relay gear 106M can be restrained.

Further, in the image forming apparatus 10 according to the present embodiment, the drive gears 104Y, 104M, 104C and 104K are disposed in the relief type layout. According to this layout, when the drive gears 104Y, 104M, 104C and 104K and the relay gears 106Y, 106M, 106C and 106K are driven, the center distance L is prevented from becoming close to the target distance, and therefore vibration of gears caused by the center distance L close to the target distance can be prevented. Consequently, image failure such as banding caused due to the vibration of gears can be prevented.

As illustrated in FIG. 18, the comparative image forming unit 1A includes legs 12 to prevent contact of the photoconductor 2 and the photoconductor gear 21 to an installation surface when the comparative image forming unit 1A is removed from the image forming apparatus 10A and is put on the installation surface such as a desk.

Figure 19:
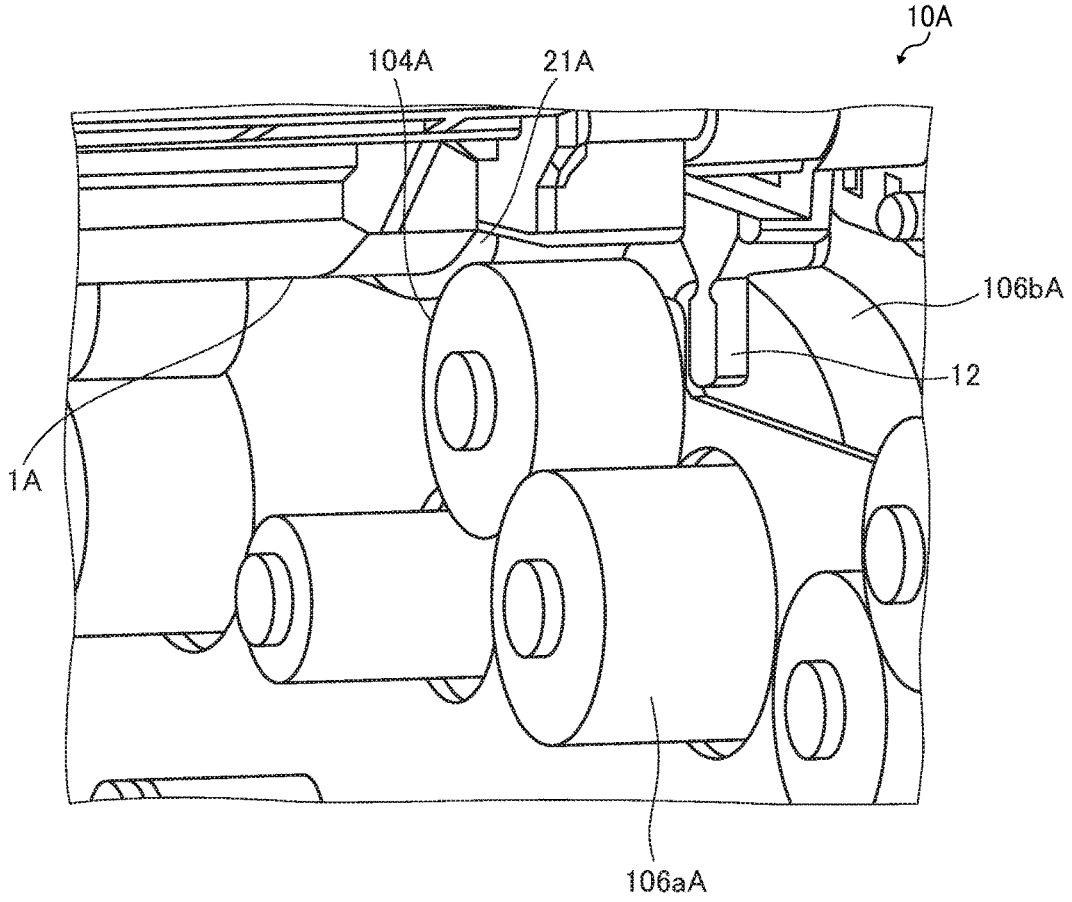
FIG. 19 is a perspective view illustrating positional relations of a drive gear and the legs of an image forming unit of the comparative image forming apparatus.

FIG. 19 is a perspective view illustrating positional relations of the drive gear 104 and the legs 12 of the image forming unit 1A of the comparative image forming apparatus 10A. As illustrated in FIG. 19, in the comparative image forming apparatus 10A, the position of the drive gear 104A and the position of each of the legs 12 in the axial direction of the drive gear 104A (i.e., a direction perpendicular to the drawing sheet of FIG. 18) are partly overlapped.

In the comparative image forming apparatus 10A, if the drive gear 104A is to be located in the relief type layout, the drive gear 104A and the legs 12 interfere with each other. Therefore, instead of the relief type layout, the bite type layout is employed to the comparative image forming apparatus 10A.

Figure 16:
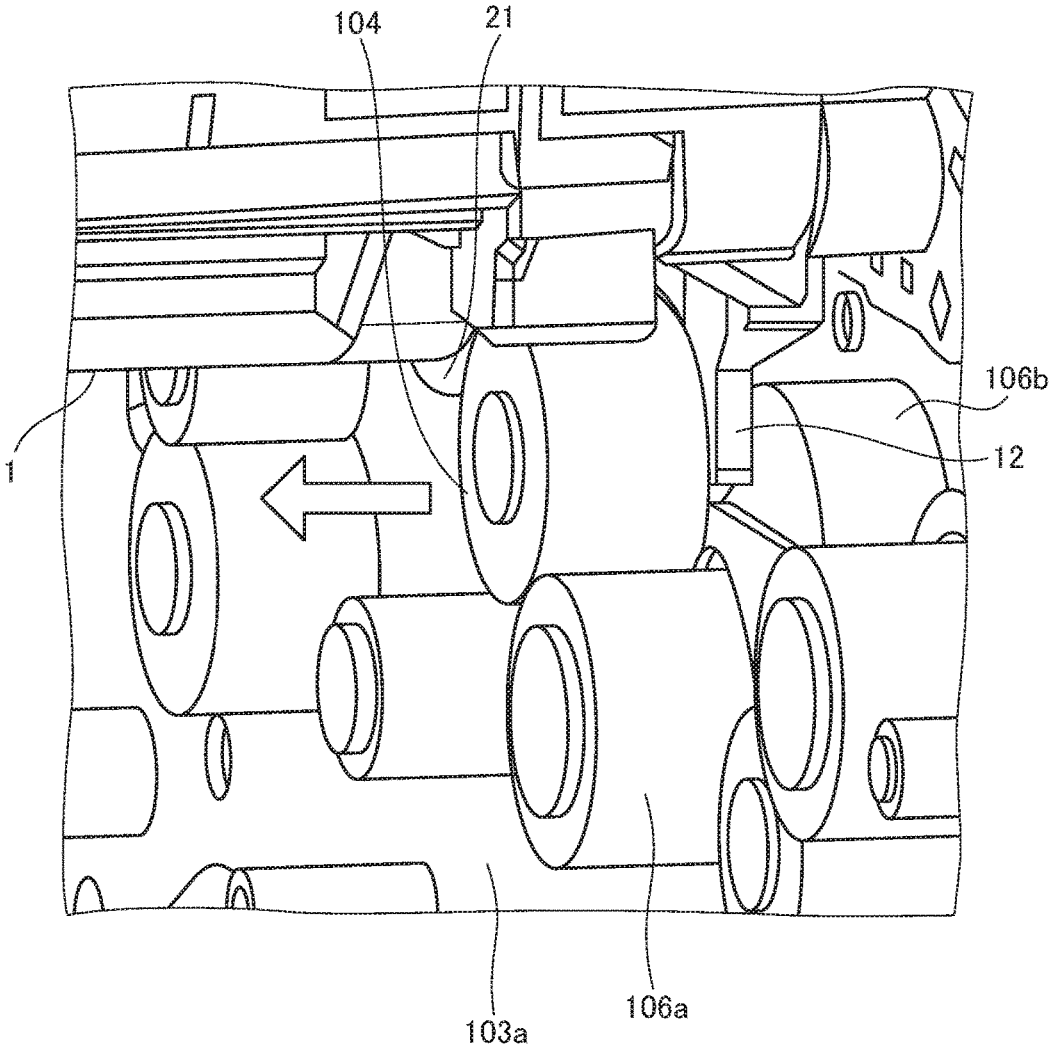
FIG. 16 is a perspective view illustrating positional relations of drive gears and legs of the drive unit.

As illustrated in FIG. 15, the image forming unit 1 according to the present embodiment also includes the legs 12. FIG. 16 is a perspective view illustrating the positional relations of the drive gear 104 and the legs 12 of the image forming apparatus 10 according to the present embodiment of this disclosure. As illustrated in FIG. 16, in the image forming apparatus 10 according to the present embodiment, the position of the drive gear 104 in the axial direction is shifted to the left side of the image forming apparatus 10 from the position of the drive gear 104A of the comparative image forming apparatus 10A illustrated in FIG. 19 (i.e., the front side in FIGS. 2 and 15 and the direction indicated by arrow in FIG. 16). According to this configuration, the position of the drive gear 104 in the axial direction and the position of each of the legs 12 are not overlapped.

Accordingly, in the image forming apparatus 10 according to the present embodiment, even when the drive gear 104 is located in the relief type layout, the drive gear 104 and the legs 12 do not interfere with each other. Therefore, the image forming apparatus 10 according to the present embodiment has the configuration suitable for the relief type layout.

Figure 17:
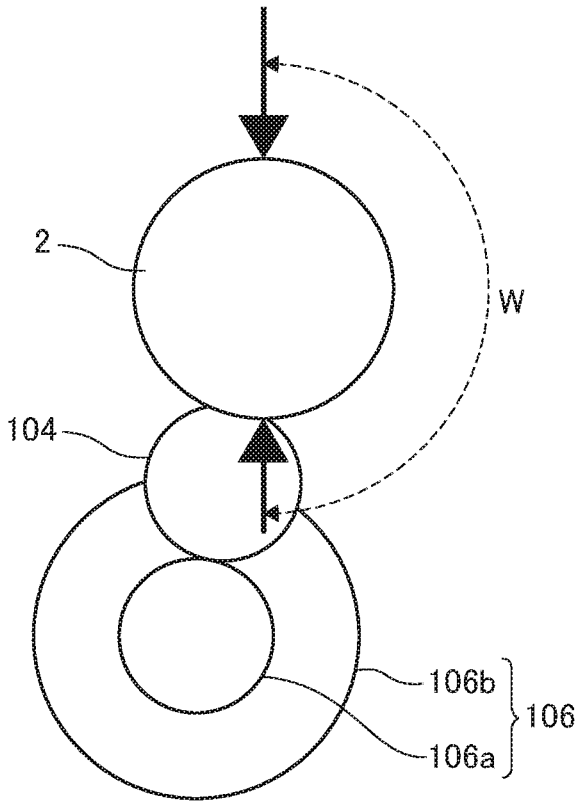
FIG. 17 is a diagram illustrating a distance from an exposure position to a transfer position on the photoconductor and a relation of the drive gear and the relay gear.

FIG. 17 is a diagram illustrating a distance from an exposure position (a latent image forming position) to a transfer position on the surface of the photoconductor 2, i.e., an exposure-to-transfer distance W in FIG. 17) and a relation of the drive gear 104 and the relay gear 106.

In the image forming apparatus 10 according to the present embodiment, while the relay gear 106 rotates for one cycle, the drive gear 104 rotates for one cycle, and the surface of the photoconductor 2 moves by the exposure-to-transfer distance W.

Specifically, the number of teeth of the small diameter gear 106*a* of the relay gear 106 is equal to the number of teeth of the drive gear 104. Accordingly, while the relay gear 106 rotates for one cycle, the drive gear 104 also rotates for one cycle.

By contrast, the number of teeth of the photoconductor gear 21 is greater than the number of teeth of the drive gear 104. Therefore, the number of teeth of the drive gear 104 to rotate for one cycle is equal to the number of teeth of the photoconductor 2 to rotate and move by the exposure-to-transfer distance W. Accordingly, while the drive gear 104 rotates for one cycle, the photoconductor 2 rotates and moves by the exposure-to-transfer distance W.

When transmitting a driving force via gears, due to the manufacturing tolerance of each gear, the rotation speed of the relay gear 106 and the rotation speed of the drive gear 104 to transmit the driving force change while the relay gear 106 and the drive gear 104 rotate for one cycle, and therefore the speed of movement of the surface of the photoconductor 2 also changes. Accordingly, if the distance of movement of the surface of the photoconductor 2 while the relay gear 106 and the drive gear 104 are rotating for one cycle is not equal to the exposure-to-transfer distance W, a period of time from exposure of the surface of the photoconductor 2 to transfer of a toner image formed on the surface of the photoconductor 2 deviates.

At this time, if the toner image is formed on the surface of the photoconductor 2 and transferred onto the intermediate transfer belt 16 in a relatively short period of time from exposure to transfer, the length of the toner image in a direction of movement of the surface of the intermediate transfer belt 16 becomes short. By contrast if the toner image is formed on the surface of the photoconductor 2 and transferred onto the intermediate transfer belt 16 in a relatively long period of time from exposure to transfer, the length of the toner image in a direction of movement of the surface of the intermediate transfer belt 16 becomes long. Consequently, the toner image to be transferred onto the surface of the intermediate transfer belt 16 is slightly extended or shrunk compared to the toner image formed on the surface of the photoconductor 2. Further, even though the respective rotation speeds of the relay gears 106Y, 106M, 106C and 106K are equal to each other, when a toner image having an extended part and a toner image having a shrunk part are overlaid, the image formation of the composite toner image results in color registration error.

By contrast, in the image forming apparatus 10 according to the present embodiment, while the relay gear 106 rotates for one cycle, the drive gear 104 rotates for one cycle, and the surface of the photoconductor 2 moves by the exposure-to-transfer distance W. Consequently, by setting the respective rotation speeds of the relay gears 106Y, 106M, 106C and 106K to be equal to each other, the periods of time from exposure to transfer for the photoconductors 2Y, 2M, 2C and 2K become equal to each other. Therefore, extension and shrink in length of a toner image to be transferred onto the surface of the intermediate transfer belt 16 can be prevented. Accordingly, the color registration error due to the extension and shrink in length of the toner image can be prevented.

The image forming apparatus 10 according to the present embodiment may employ a crowning gear as the drive gear 104. The crowning gear is a gear having a curved surface on a face to mesh with a mating gear when the gears are meshed with each other, such that the width of the center part in the axial direction of a tooth of the gear is wide and the width of the axial end thereof is narrow. By employing the crowning gear, the contact of teeth of mating gears is concentrated to the center part. According to this configuration, the precision of a center distance of the photoconductor gear 21 and the relay gear 106 is enhanced. Consequently, the vibration of rotation of each gear can be restrained when the gears are driven, the occurrence of rotation nonuniformity of the photoconductor 2 can be restrained, and therefore the image quality can be enhanced.

The configurations according to the above-descried embodiments are not limited thereto. This disclosure can achieve the following aspects effectively.

Aspect A.

In Aspect A, an image forming apparatus (for example, the image forming apparatus 10) includes multiple image bearers (for example, the photoconductors 2), multiple image bearer gears (for example, the photoconductor gears 21), a drive source (for example, the drive motor 105), an output gear (for example, the output gear 115), a drive transmission body (for example, the relay gear 106M and the drive distributing relay gear 107), multiple relay gears (for example, the relay gears 106), and multiple drive gears (for example, the drive gears 104). The multiple image bearers have respective shafts (for example, the photoconductor center shaft 20). The multiple image bearer gears are mounted on the respective shafts of the multiple image bearers. The drive source is configured to rotate the multiple image bearers. The output gear is configured to output a driving force applied by the drive source. The multiple relay gears are configured to receive and relay the driving force from the output gear directly or via the drive transmission body to the multiple image bearer gears. The multiple drive gears have respective shafts and are configured to connect to the multiple relay gears and the multiple image bearer gears and to transmit the driving force from the multiple relay gears to the multiple image bearer gears. A center of rotation of each of the multiple drive gears to which the driving force is transmitted from the drive source is located downstream from a corresponding one of the multiple relay gears in a rotation direction of the corresponding one of the multiple relay gears, relative to a virtual line segment connecting a center of rotation of the corresponding one of the multiple relay gears connected to the multiple drive gears and a center of rotation of a corresponding one of the multiple image bearer gears.

According to this configuration, as described in the above-described embodiment, occurrence of vibration when the driving force to drive and rotate the multiple image bearers is input to the multiple image bearers can be prevented or restrained in the configuration in which a single drive source drives and rotates the multiple image bearers. The above-described effect was obtained as a result of intensive studies to find that the drive gear is shifted to a downstream side in the rotation direction of the relay gear at a connecting portion of the drive gear and the relay gear when the driving force is input. Therefore, if any of the multiple drive gears is located at an upstream side in the rotation direction of the relay gear, relative to the above-described virtual line segment, when the driving force to drive and rotate, the drive gear is shifted toward the closest position of the relay gear and the image bearer gear connected by the virtual line segment.

According to this action of the drive gear, the center distance of the shaft of the drive gear and the shaft of the image bearer gear to the target distance decreases, and therefore vibration is generated to the drive gear and the image bearer gear.

By contrast, in Aspect A, since the center of rotation of each of the multiple drive gears to which the driving force is transmitted from a single drive source is located downstream from the virtual line segment in the rotation direction of the multiple relay gears, when the driving force to drive and rotate is input, the drive gear is shifted to move away from the closest drive source of the relay gear and the image bearer gear. Consequently, the center distance of the drive gear and the image bearer gear increases. Accordingly, since the center distance of the drive gear and the image bearer gear does not become smaller, occurrence of vibration when the driving force to the multiple image bearers is input can be prevented or restrained.

Aspect B.

In Aspect B, an image forming apparatus (for example, the image forming apparatus 10) includes multiple image bearers (for example, the photoconductors 2), multiple image bearer gears (for example, the photoconductor gears 21), a drive source (for example, the drive motor 105), an output gear (for example, the output gear 115), a drive transmission body (for example, the relay gear 106M and the drive distributing relay gear 107), multiple relay gears (for example, the relay gears 106), and multiple drive gears (for example, the drive gears 104). The multiple image bearers have respective shafts (for example, the photoconductor center shaft 20). The multiple image bearer gears are mounted on the respective shafts of the multiple image bearers. The drive source is configured to rotate the multiple image bearers. The output gear is configured to output a driving force applied by the drive source. The multiple relay gears have respective shafts and are configured to receive and relay the driving force from the output gear directly or via the drive transmission body to the multiple image bearer gears. The multiple relay gears include a first relay gear (for example, the relay gear 106M) and a second relay gear (for example, the relay gear 106C) to which the driving force is input from the first relay gear. The multiple drive gears have respective shafts and are configured to connect to the multiple relay gears and the multiple image bearer gears and to transmit the driving force from the multiple relay gears to the multiple image bearer gears. The multiple drive gears include a first drive gear (for example, the drive gear 104M) configured to connect the first relay gear. A center of rotation of the first drive gear is located downstream from the first relay gear in a rotation direction of the first relay gear, relative to a virtual line segment connecting a center of rotation of the first relay gear and a center of rotation of the image bearer gear.

Consequently, as described in the above-described embodiment, when the driving force to drive and rotate is input to the multiple image bearer gears, the drive gear moves away from the closest position of the relay gear and the image bearer gear. Accordingly, the center distance of the first drive gear and the first relay gear increases more than the center distance before the start of driving. The driving load of the first relay gear that transmits the driving force to the second relay gear increases more than the driving load of the other relay gears, which can easily cause quick wear of the first relay gear. In a case in which the center distance of the first relay gear and the first drive gear decreases, the tip of tooth of one gear and the root of tooth of the other gear contact to each other, and vice versa. Therefore, due to the contact of the tip of one gear and the root of the other gear, it is likely that the wear of the first relay gear becomes worse.

By contrast, in Aspect B, the center distance of the first drive gear and the first relay gear increases more than the center distance before the start of driving. Accordingly, since the center distance of the first drive gear and the first relay gear does not become smaller, wear of the first relay gear can be prevented from becoming worse.

Aspect C.

In Aspect A or Aspect B, each center of rotation of the multiple drive gears (for example, the multiple drive gears 104) is located downstream from the corresponding one of the multiple relay gears (for example, the multiple relay gears 106) in a rotation direction of the corresponding one of the multiple relay gears, relative to a virtual line segment connecting a center of rotation of the corresponding one of the multiple relay gears connected to the multiple drive gears and the center of rotation of the corresponding one of the multiple image bearer gears (for example, the multiple photoconductor gears 21).

According to this configuration, an image failure such as abnormal image caused by occurrence of vibration when the driving force to drive and rotate the multiple image bearers (for example, the photoconductors 2) is input to the multiple image bearers can be prevented or restrained.

Aspect D.

In any one of Aspect A through Aspect C, the image forming apparatus (for example, the image forming apparatus 10) further includes an image bearer gear holder (for example, the photoconductor positioning member 101) and a drive gear holder (for example, the drive gear holder 103). The image bearer gear holder is configured to hold the respective shafts (for example, the photoconductor center shafts 20) of the multiple image bearers (for example, the photoconductor gears 21), on which the multiple image bearer gears are mounted. The drive gear holder is configured to hold the respective shafts (for example, the rotary shafts 114) of the multiple drive gears (for example, the drive gears 104). The image bearer gear holder and the drive gear holder are disposed at variable relative positions.

According to this configuration, as described in the above-described embodiments, image failure caused by vibration that is generated when the image bearer gear to drive and rotate the image bearer and the drive gear that is meshed with the image bearer gear are driven can be prevented.

Aspect E.

In Aspect D, the image forming apparatus (for example, the image forming apparatus 10) further includes a drive device (for example, the photoconductor drive unit 100) having the image bearer gear holder (for example, the photoconductor positioning member 101) and the drive gear holder (for example, the drive gear holder 103) integrally provided by adjusting the relative positions and fixing to each other. The drive device is detachably attachable to an apparatus body of the image forming apparatus.

According to this configuration, as described in the above-described embodiments, an operator can easily adjust the center distance of the image bearer gear (for example, the photoconductor gear 21) and the drive gear (for example, the drive gear 104) at a different place from the apparatus body of the image forming apparatus.

Aspect F.

In Aspect E, the image forming apparatus (for example, the image forming apparatus 10) further includes a fixing body (for example, the second drive gear holding member 103*b*) to which the image bearer gear holder (for example, the photoconductor positioning member 101) and the drive gear holder (for example, the first drive gear holding member 103*a*) are fixed. The fixing body is disposed between or outside the image bearer gear holder and the drive gear holder. Each two of the image bearer gear holder, the drive gear holder and the fixing body are fixed by each other, by which the drive device (for example, the photoconductor drive unit 100) includes a layered structure formed with the image bearer gear holder, the drive gear holder and the fixing body.

According to this configuration, as described in the above-described embodiment, the strength of the drive unit increases. Accordingly, vibration of the drive device caused by rotations of the gears decreases when the driving force to drive and rotate is input.

Aspect G.

In Aspect E or Aspect F, the drive device (for example, the photoconductor drive unit 100) includes a relay gear holder (for example, the photoconductor positioning member 101) configured to hold the respective shafts (for example, the rotary shafts 116) of the multiple relay gears (for example, the relay gears 106). The drive source (for example, the drive motor 105) is positioned to the relay gear holder.

According to this configuration, as described in the above-described embodiments, the center distance of the drive output gear (for example, the output gear 115) to output the driving force applied by the drive source and the relay gear (for example, the output gear 115) can be determined with high accuracy. The driving force from the drive source can be transmitted from the output gear to the relay gear without any loss of the amount of driving force.

Aspect H.

In any one of Aspect E through Aspect G, the image forming apparatus (for example, the image forming apparatus 10) further includes a frame (for example, the side panel frame 1*a*) having an opening (for example, the opening 1*b*) and configured to attach the drive device from outside the apparatus body.

According to this configuration, as described in the above-described embodiment, the drive device (for example, the photoconductor drive unit 100) can be replaced and attached to the apparatus body of the image forming apparatus with a direct access thereto from outside the apparatus body of the image forming apparatus, and performance in service and maintenance of the image forming apparatus can be enhanced.

Aspect I.

In any one of Aspect D through Aspect H, the image forming apparatus (for example, the image forming apparatus 10) further includes adjusters (for example, the drive unit adjusters 108) configured to adjust the relative positions. The adjusters are provided to the image bearer gear holder and the drive gear holder. The adjusters further function as fixing bodies configured to fix the image bearer gear holder and the drive gear holder.

According to this configuration, as described in the above-described embodiment, since the adjusters and the fixing bodies are made of the same parts, the drive device (for example, the photoconductor drive unit 100) can be assembled with high accuracy with the minimum number of parts and components.

Aspect J.

In any one of Aspect D through Aspect I, the image forming apparatus (for example, the image forming apparatus 10) further includes a holding portion (for example, the photoconductor positioning portion 102) and a fitting tool (for example, the positioning tool 200). The holding portion is configured to hold and position the respective shafts (for example, the photoconductor center shafts 20) of the multiple image bearer gears (for example, the photoconductor gears 21) attached to the image bearer gear holder (for example, the photoconductor positioning member 101). The fitting tool has a contact body (for example, the reference pins 201) and a positioning body (for example, the retaining pins 203). The drive gear holder has a positioning opening (for example, the positioning holes 110). While the holding portion contacts the contact body of the fitting tool and the positioning body of the fitting tool is inserted into the positioning opening of the drive gear holder (for example, the drive gear holder 103), the image bearer gear holder and the drive gear holder are fixed, operable to position the relative positions.

According to this configuration, as described in the above-described embodiments, by using the fitting tool in assembly of the drive device, the assembly can be performed with high accuracy in positioning.

Aspect K.

In Aspect J, the contact body (for example, the reference pins 201) is detachably attached to a body of the fitting tool (for example, the positioning tool 200). The relative positions of the image bearer gear holder (for example, the photoconductor positioning member 101) and the drive gear holder (for example, the drive gear holder 103) are changeable by replacement of the contact body.

According to this configuration, as described in the above-described embodiments, the center distance between the shaft of the image bearer gear (for example, the photoconductor gear 21) and the shaft of the drive gear (for example, the drive gear 104) can be finely adjusted with the simple configuration.

Aspect L.

In any one of Aspect A through Aspect J, the image forming apparatus (for example, the image forming apparatus 10) further includes a process cartridge (for example, the image forming unit 1) detachably attached to an apparatus body of the image forming apparatus. The process cartridge is configured to include at least an image bearer (for example, the photoconductor 2), an image bearer gear (for example, the photoconductor gear 21), and a developing device (for example, the developing device 5) configured to develop a latent image into a toner image.

According to this configuration, as described in the above-described embodiments, the performance in service and maintenance of the image bearer and the developing device of the image forming apparatus can be enhanced.

Aspect M.

In Aspect L, when the image bearer (for example, the photoconductor 2) is driven in a state in which the process cartridge (for example, the image forming unit 1) is attached to the apparatus body and the image bearer gear (for example, the photoconductor gear 21) are meshed with each other, a force (for example, the force F) having a component opposite to a direction to detach the process cartridge from the apparatus body acts on the image bearer gear.

According to this configuration, as described in the above-described embodiment, since a common part or component can be used to drive the image bearer and to prevent floating of the process cartridge, an increase in the number of parts and components can be restrained.

Aspect N.

In any one of Aspect A through Aspect M, the drive gear (for example, the drive gear 104) is a crowning gear.

Consequently, as described in the above-described embodiment, the occurrence of rotation nonuniformity of the image bearer can be restrained, and therefore the image quality can be enhanced.

Aspect O.

In any one of Aspect A through Aspect N, the image forming apparatus (for example, the image forming apparatus 10) further includes a latent image forming device (for example, the writing unit 70) configured to form a latent image on the image bearer (for example, the photoconductor 2). The image bearer includes a latent image bearer configured to bear a latent image formed by the latent image forming device at a latent image forming position and developed into a toner image by a developing device (for example, the developing device 5), while rotating, and to transfer the toner image onto either one of an intermediate transfer body (for example, the intermediate transfer belt 16) and a sheet (for example, the sheet P). The number of teeth of each of the multiple relay gears (for example, the relay gears 106) is equal to the number of teeth of each of the multiple drive gears (for example, the multiple drive gears 104). Each of the multiple image bearer gears has the number of teeth to rotate, operable to move a surface of the image bearer from the latent image forming position to the image bearer gear while each of the multiple relay gears and each of the multiple drive gears rotate for one cycle.

According to this configuration, as described in the above-described embodiment, the color registration error due to the manufacturing tolerance of each gear such as the extension and shrink in length of the toner image can be prevented, and therefore the image quality can be enhanced.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

multiple image bearers having respective shafts;

multiple image bearer gears mounted on the respective shafts of the multiple image bearers;

a drive source configured to rotate the multiple image bearers;

a first output gear configured to output a driving force applied by the drive source, the first output gear being a single gear associated with at least two image bearers of the multiple image bearers;

a second output gear configured to output a driving force applied by the drive source, the second output gear being a single gear associated with at least one image bearer of the multiple image bearers;

a drive transmission body;

multiple relay gears having respective shafts and configured to receive and relay the driving force from one of the first output gear or the second output gear directly or via the drive transmission body to the multiple image bearer gears, the multiple relay gears including a first relay gear and a third relay gear to which the driving force is input from the first output gear, a second relay gear to which the driving force is input from the first relay gear, and a fourth relay gear to which the driving force is input from the second output gear; and multiple drive gears, the multiple drive gears each having a respective shaft defining a center of rotation thereof and configured to connect to the multiple relay gears and the multiple image bearer gears and to transmit the driving force from the multiple relay gears to the multiple image bearer gears, the shaft of each of the multiple drive gears being arranged such that the center of rotation of each of the multiple drive gears is downstream from a corresponding one of the multiple relay gears in a rotation direction of the corresponding one of the multiple relay gears, relative to a virtual line segment connecting a center of rotation of the corresponding one of the multiple relay gears and a center of rotation of corresponding one of the multiple image bearer gears.

2. The image forming apparatus according to claim 1, further comprising:

an image bearer gear holder configured to hold the respective shafts of the multiple image bearers, on which the multiple image bearer gears are mounted; and a drive gear holder configured to hold the respective shafts of the multiple drive gears, wherein the image bearer gear holder and the drive gear holder are disposed at variable relative positions.

3. The image forming apparatus according to claim 2, further comprising:

a drive device having the image bearer gear holder and the drive gear holder integrally provided by adjusting the relative positions and fixing to each other, wherein the drive device is detachably attachable to an apparatus body of the image forming apparatus.

4. The image forming apparatus according to claim 3, further comprising:

a fixing body to which the image bearer gear holder and the drive gear holder are fixed, wherein the fixing body is disposed between or outside the image bearer gear holder and the drive gear holder, and wherein each two of the image bearer gear holder, the drive gear holder and the fixing body are fixed by each other, by which the drive device includes a layered structure formed with the image bearer gear holder, the drive gear holder and the fixing body.

5. The image forming apparatus according to claim 3, wherein the drive device includes a relay gear holder configured to hold the respective shafts of the multiple relay gears, and wherein the drive source is positioned to the relay gear holder.

6. The imaging forming apparatus according to claim 1, the at least two image bearers of the multiple image bearers are three image bearers, and the three image bearers associated with the first output gear each associated with a respective single color toner, the respective color toner being one of cyan, magenta, or yellow.

* * * * *